US007978035B2

(12) United States Patent
Usami et al.

(10) Patent No.: US 7,978,035 B2
(45) Date of Patent: Jul. 12, 2011

(54) MAGNET SWITCH WITH MAGNETIC CORE DESIGNED TO ENSURE STABILITY IN OPERATION THEREOF

(75) Inventors: Shinji Usami, Okazaki (JP); Tomohiro Teramachi, Kariya (JP)

(73) Assignee: Denso Corporation, Kariya (JP)

( * ) Notice: Subject to any disclaimer, the term of this patent is extended or adjusted under 35 U.S.C. 154(b) by 406 days.

(21) Appl. No.: 12/219,916

(22) Filed: Jul. 30, 2008

(65) Prior Publication Data

US 2009/0039990 A1 Feb. 12, 2009

(30) Foreign Application Priority Data

Aug. 8, 2007 (JP) ..... 2007-206266
Nov. 12, 2007 (JP) ..... 2007-293545
Jun. 6, 2008 (JP) ..... 2008-149173

(51) Int. Cl.
*H01H 67/02* (2006.01)
*H01F 3/00* (2006.01)
*H01F 7/08* (2006.01)

(52) U.S. Cl. ..... 335/131; 335/126; 335/278; 335/281; 335/297; 29/596

(58) Field of Classification Search ..... 335/126–132, 335/135, 180, 255, 273–274, 278–279, 281, 335/296–298; 310/12, 14, 23, 34, 179, 193, 310/216, 258, 259; 29/596
See application file for complete search history.

(56) References Cited

U.S. PATENT DOCUMENTS 3,509,505 A * 4/1970 Zagrzjewski ..... 335/274
3,509,506 A * 4/1970 Bird ..... 335/274
3,822,469 A * 7/1974 Lazenby ..... 29/596
4,203,084 A 5/1980 Yamaguchi et al.
5,075,150 A 12/1991 Webb et al.
5,181,002 A * 1/1993 Sugiyama ..... 335/131
6,281,770 B1 8/2001 Quentric
6,578,689 B2 * 6/2003 Kawada et al. ..... 192/84.961

(Continued)

FOREIGN PATENT DOCUMENTS

FR 1 536 052 A 8/1968

(Continued)

OTHER PUBLICATIONS

Japanese Office Action issued in Japanese Application No. 2007-293545; Dispatched on Dec. 22, 2009 (With Translation).

(Continued)

*Primary Examiner* — Anh T Mai
*Assistant Examiner* — Mohamad A Musleh
(74) *Attorney, Agent, or Firm* — Oliff & Berridge, PLC

(57) ABSTRACT

A magnet switch which may be employed in automotive engine starters is provided. The magnet switch includes a stationary magnetic core made up of a disc assembly and a core body. The disc assembly is made of a stack of annular plate members superposed on each other. Each of the plate members has an opening through which a terminal lead of a magnetic coil extends. The core body has a boss with an edge which is plastically deformed outwardly in the radius direction thereof or staked to create an elastic nip which retains the stack of the plate members firmly on the core body. This structure ensures the joint between the disc assembly and the core body to withstand mechanical impact exerted on the magnetic core and stability in operation of the magnet switch without increasing a total production cost of the magnetic switch.

3 Claims, 19 Drawing Sheets

U.S. PATENT DOCUMENTS

| | | | | |
|---|---|---|---|---|
| 2001/0026727 | A1 | 10/2001 | Okabe et al. | |
| 2005/0093665 | A1 | 5/2005 | Imanishi et al. | |
| 2007/0013255 | A1* | 1/2007 | Wakitani et al. | 310/216 |
| 2007/0120632 | A1* | 5/2007 | Tsukada et al. | 335/220 |
| 2007/0188278 | A1 | 8/2007 | Tsukada et al. | |
| 2007/0194867 | A1 | 8/2007 | Kurasawa et al. | |
| 2007/0194868 | A1 | 8/2007 | Kurasawa | |

FOREIGN PATENT DOCUMENTS

| | | | |
|---|---|---|---|
| FR | 1 570 596 | A | 6/1969 |
| FR | 2 783 089 | A1 | 3/2000 |
| JP | U-63-167640 | | 11/1988 |
| JP | A-02-075424 | | 3/1990 |
| JP | U-05-093627 | | 12/1993 |
| JP | A-2001-276939 | | 10/2001 |
| JP | A-2002-524826 | | 8/2002 |
| JP | A-2003-251433 | | 9/2003 |
| JP | A-2005-034857 | | 2/2005 |
| JP | A-2005-108530 | | 4/2005 |
| JP | A-2005-111491 | | 4/2005 |
| JP | 2007165020 | A * | 6/2007 |
| JP | A-2007-165247 | | 6/2007 |
| JP | A-2007-227157 | | 9/2007 |
| JP | A-2007-242585 | | 9/2007 |
| JP | A-2008-034333 | | 2/2008 |

OTHER PUBLICATIONS

Japanese Office Action issued in Application No. 2007-293545; Dispatched on Mar. 30, 2010 (With Translation).

Partial European Search Report issued in European Application No. EP 08 01 2778.

* cited by examiner

MAGNET SWITCH WITH MAGNETIC CORE DESIGNED TO ENSURE STABILITY IN OPERATION THEREOF

CROSS REFERENCE TO RELATED DOCUMENT

The present application claims the benefit of Japanese Patent Application Nos. 2007-206266 filed on Aug. 8, 2007, 2007-293545 filed on Nov. 12, 2007, and 2008-149173 filed on Jun. 6, 2008, the disclosure of which is incorporated herein by reference.

BACKGROUND OF THE INVENTION

1. Technical Field of the Invention

The present invention relates generally to a magnet switch which may be employed in an engine starter working to start an internal combustion engine of automotive vehicles, and more particularly to an improved structure of such a magnet switch designed to have improved resistance to impact shock occurring during operation of the magnet switch without increasing production costs.

2. Background Art

Japanese translation No. 2002-524826 of a PCT internal patent application teaches a magnet switch which is, as illustrated in FIG. 20, equipped with a disc assembly made 110 of a stack of annular sheets 111 and a cylindrical core body 100 disposed in alignment with a plunger (i.e., a movable core). The cylindrical core body 100 is fit in a center hole 112 of the disc assembly 110. Terminal leads of a magnetic coil extend in an axial direction of the magnet switch through grooves formed in the periphery of the disc assembly 110. The outermost one of the annular sheets of the disc assembly 110 has a tab 400 formed by cutting and bending a portion thereof for retaining the terminal leads of the coil.

The above structure, however, has the following drawbacks. The installation of the disc assembly 110 on the cylindrical core body 100 requires the alignment of recesses formed in the periphery of the annular sheets 111 which define the grooves through which terminal leads of the coil extend. Specifically, it is necessary to align the recesses in sequence so as to coincide with one another upon the installation of the disc assembly 110 on the core body 100. Alternatively, it is necessary to align the recesses of the annular sheets 111 to make a stack thereof and then fit the stack on the core body 100. This is, however, very troublesome and requires upskilling workers.

Additionally, the tab 400 formed on the outermost one of the sheets of the disc assembly 110 obstructs soldering of the end of the coil to the disc assembly 110, thus resulting in a decrease in workability.

Further, when the coil is excited, and the plunger hits the core body 100, it will cause the impact to be transmitted to the end of the coil soldered to the surface of the sheets of the disc assembly. The disc assembly is, therefore, designed to form the tab 400 for withstanding the impact. This results in an increase in total production const of the magnet switch.

The core body 100 is, as can be seen in the drawing, made up of a base 101 and a boss 102. The base 101 faces the plunger. The boss 102 extends from the base 101 away from the plunger.

When the magnet switch is open or closed so many times, it may cause the boss 102 to escape from the center hole 112. Specifically, when the sheets 111 of the disc assembly 110 are each punched out to form circular holes defining the center hole 112, it may result in a variation in inner diameter among the sheets 111, deformation in shape of the circular holes, or a lack in sheared area of the circular holes, which leads to a lack in degree of press-fitting of the boss 102 to the center hole 112 of the disc assembly 110. Therefore, when the plunger is being attracted to the base 101, the reactive force or compressive pressure, as produced by a drive spring installed in the plunger, may pull the plunger to dislodge the boss 102 from the disc assembly 110.

SUMMARY OF THE INVENTION

It is therefore a principal object of the invention to avoid the disadvantages of the prior art.

It is another object of the invention to provide an improved structure of a magnet switch designed to have enhanced resistance to the impact without complicating production processes thereof and/or ensure the stability of joint between a disc assembly and a core body of a stationary magnetic core.

According to one aspect of the invention, there is provided a magnet switch which may be installed in a starter for internal combustion engines. The magnet switch comprises: (a) a switch cover having a contact chamber formed therein; (b) a fixed contact disposed inside the switch cover; (c) a movable contact disposed inside the switch cover; (d) a coil bobbin; (e) a movable core that is movable along a given travel path; (f) a stationary core including a disc assembly and a cylindrical core body, the disc assembly having formed therein a fitting hole which is fit on the cylindrical core body and being disposed between an end of the coil bobbin and the switch cover so as to orient one of opposed major surfaces thereof toward the movable core; (g) a coil wound around the coil bobbin, when excited, the coil producing magnetic force through the stationary core to move the movable core along the given travel path to bring the movable contact into abutment with the fixed contact; and (h) a sealing member retained between the other of the opposed major surfaces of the disc assembly and the switch cover in abutment with an end of the switch cover.

The disc assembly is made of a stack of annular plate members superposed on each other in a thickness-wise direction thereof. Each of the annular plate members has an opening through which a terminal lead of the coil extends. The annular plate members are broken down into a first group including at least one of the annular plate members and a second group including others of the annular plate members. The annular plate members of the second group have embossed protrusions which project in the thickness-wise direction thereof and are fit in one another. The at least one of the annular plate members of the first group has a hole in which the embossed protrusion of one of the annular plate members of the second group is fit.

Specifically, the embossed protrusions are fit in each other, thereby holding the annular plate members from rotating in the circumferential direction and facilitates the alignment or coincidence of the openings of the annular plate members during the fabrication of the disc assembly. The embossed protrusions also facilitate the assembling of the annular plate members, which ensures the stability of joining of the disc assembly to the core body of the magnetic core and results in improved ability to resist the impact inputted to the magnetic core during operation of the magnetic switch.

In the preferred mode of the invention, each of the annular plate members has two of the embossed protrusions which are diametrically opposed to each other across the center of the annular plate member.

The annular plate members of the second group have recesses each of which is formed in an underside of one of the embossed protrusions, thereby enabling the fitting of each of the protrusions in one of the recesses in face-to-fact contact between adjacent two of the plate members to improve the ability of the disc assembly in resisting to the impact.

According to the second aspect of the invention, there is provided a magnet switch which comprises: (a) a switch cover having a contact chamber formed therein; (b) a fixed contact disposed inside the switch cover; (c) a movable contact disposed inside the switch cover; (d) a coil bobbin; (e) a movable core that is movable along a given travel path; (f) a stationary core including a disc assembly and a cylindrical core body, the cylindrical core body having opposed ends, an outer shoulder, and a peripheral wall extending between the outer shoulder and one of the opposed ends which faces the movable contact, the disc assembly being disposed between an end of the coil bobbin and the switch cover so as to orient one of opposed major surfaces thereof toward the movable core; (g) a coil wound around the coil bobbin, when excited, the coil producing magnetic force through the stationary core to move the movable core along the given travel path to bring the movable contact into abutment with or away from the fixed contact; and (h) a sealing member retained between the other of the opposed major surfaces of the disc assembly and the switch cover in abutment with an end of the switch cover.

The disc assembly is made of a stack of annular plate members superposed on each other in a thickness-wise direction thereof and has a fitting hole extending through a thickness of the stack. Each of the annular plate members has an opening through which a terminal lead of the coil extends. Each of the annular plate members has a hole which defines the fitting hole of the disc assembly. The disc assembly is fit at the fitting hole on the peripheral wall of the cylindrical core body. The annular plate members are broken down into a first group including at least one of the annular plate members and a second group including others of the annular plate members which are laid adjacent each other. The first group has the one of the opposed major surfaces facing the movable contact. The second group has the other of the opposed major surfaces. An edge of the one of the opposed ends of the cylindrical core body facing the movable contact is plastically deformed outward in a radius direction of the cylindrical core body to create an elastic nip which retains the stack of the annular plate members of the disc assembly between the edge and the outer shoulder of the cylindrical core body. The at least one of the annular plate members of the first group has formed in an circumference of the hole thereof a recess within which the plastically deformed edge of the one of the opposed ends of the cylindrical core body is disposed so that the plastically deformed edge does not project from the end surface of the disc assembly, thereby avoiding the addition of mechanical stress, as arising from the impact or vibrations inputted to the disc assembly, to the sealing member located adjacent the disc assembly to minimize the fatigue or any defects in operation of the sealing member.

In the preferred mode of the invention, the at least one of the annular plate members of the first group is greater in thickness than the second group of the annular plate members to enhance the rigidity of the disc assembly.

The annular plate members of the second group have embossed protrusions which project in a thickness-wise direction thereof and are fit in one another. The at least one of the annular plate members of the first group has a hole in which the embossed protrusion of one of the annular plate members of the second group is fit.

According to the third aspect of the invention, there is provided a magnet switch which comprises: (a) a switch cover having a contact chamber formed therein; (b) a fixed contact disposed inside the switch cover; (c) a movable contact disposed inside the switch cover; (d) a coil bobbin; (e) a movable core that is movable along a given travel path; (f) a stationary core including a disc assembly and a cylindrical core body, the disc assembly having formed therein a fitting hole which is fit on the cylindrical core body and being disposed between an end of the coil bobbin and the switch cover so as to orient one of opposed major surfaces thereof toward the movable core; (g) a coil wound around the coil bobbin, when excited, the coil producing magnetic force through the stationary core to move the movable core along the given travel path to bring the movable contact into abutment with or away from the fixed contact; and (h) a sealing member retained between the other of the opposed major surfaces of the disc assembly and the switch cover in abutment with an end of the switch cover.

The disc assembly is made of a stack of annular plate members superposed on each other in a thickness-wise direction thereof. Each of the annular plate members has an opening through which a terminal lead of the coil extends. The annular plate members all have embossed protrusions which project in the thickness-wise direction thereof and are fit in one another. The sealing member has a hole in which the embossed protrusion of an adjacent one of the annular plate members is disposed. The embossed protrusions may alternatively be reversed in orientation, that is, project toward the end of the bobbin. In this case, the end of the bobbin has a hole I which the embossed protrusion of an adjacent one of the annular plate member is disposed.

According to the fourth aspect of the invention, there is provided a magnet switch which comprises: (a) a switch cover having a contact chamber formed therein; (b) a fixed contact disposed inside the switch cover; (c) a movable contact disposed inside the switch cover; (d) a coil bobbin; (e) a movable core that is movable along a given travel path; (f) a stationary core including a disc assembly and a cylindrical core body, the cylindrical core body having opposed ends, an outer shoulder, and a peripheral wall extending between the outer shoulder and one of the opposed ends which faces the movable contact, the disc assembly being disposed between an end of the coil bobbin and the switch cover so as to orient one of opposed major surfaces thereof toward the movable core; (g) a coil wound around the coil bobbin, when excited, the coil producing magnetic force through the stationary core to move the movable core along the given travel path to bring the movable contact into abutment with or away from the fixed contact; and (h) a sealing member retained between the other of the opposed major surfaces of the disc assembly and the switch cover in abutment with an end of the switch cover. The sealing member has a through hole in which the one of the opposed end of the cylindrical core body is disposed.

The disc assembly is made of a stack of annular plate members superposed on each other in a thickness-wise direction thereof and has a fitting hole extending through a thickness of the stack. Each of the annular plate members has an opening through which a terminal lead of the coil extends. Each of the annular plate members has a hole which defines the fitting hole of the disc assembly. The disc assembly is fit at the fitting hole on the peripheral wall of the cylindrical core body. An edge of the one of the opposed ends of the cylindrical core body facing the movable contact is plastically deformed outward in a radius direction of the cylindrical core body to create an elastic nip which retains the stack of the annular plate members of the disc assembly between the edge and the outer shoulder of the cylindrical core body. The sealing member has formed in an circumference of the through hole thereof a recess within which the plastically deformed edge of the one of the opposed ends of the cylindrical core body is disposed.

According to the fifth aspect of the invention, there is provided a magnet switch which comprises: (a) a switch cover having a contact chamber formed therein; (b) a fixed contact disposed inside the switch cover; (c) a movable contact disposed inside the switch cover; (d) a coil bobbin; (e) a movable core that is movable along a given travel path; (f) a stationary core including a disc assembly and a cylindrical core body, the cylindrical core body having opposed ends and a peripheral wall portion, one of the opposed ends facing the movable core, the peripheral wall portion leading to the other of the opposed ends, the disc assembly being disposed between an end of the coil bobbin and the switch cover so as to orient one of opposed major surfaces thereof toward the movable core; (g) a coil wound around the coil bobbin, when excited, the coil producing magnetic force through the stationary core to move the movable core along the given travel path to bring the movable contact into abutment with or away from the fixed contact; and (h) a sealing member retained between the other of the opposed major surfaces of the disc assembly and the switch cover in abutment with an end of the switch cover.

The disc assembly is made of a stack of annular plate members superposed on each other in a thickness-wise direction thereof and has a fitting hole extending through a thickness of the stack. Each of the annular plate members has a hole defining the fitting hole of the disc assembly which is fit on the peripheral wall portion of the cylindrical core body. An outermost one of the annular plate members of the disc assembly facing the movable contact is greater in thickness than others of the annular plate member, thereby ensuring a desired degree of rigidity to withstand the deformation of the disc assembly and avoiding the distortion of the outermost plate member.

In the preferred mode of the invention, the thickness of the outermost one of the annular plate members is two to five times greater than those of the others of the annular plate members.

The cylindrical core body has opposed ends, an outer shoulder, and a peripheral wall extending between the outer shoulder and one of the opposed ends which faces the movable contact. At least a portion of an edge of the one of the opposed ends of the cylindrical core body facing the movable contact is plastically staked to create an elastic nip which retains the stack of the annular plate members of the disc assembly between the edge and the outer shoulder of the cylindrical core body.

The edge of the one of the opposed ends of the cylindrical core body facing the movable contact has tabs which are plastically staked to create the elastic nip which retains the stack of the annular plate members of the disc assembly between the edge and the outer shoulder of the cylindrical core body.

According to the sixth embodiment of the invention, there is provided a magnet switch which comprises: (a) a stationary core; (b) a movable core; and (c) a magnetic coil that, when excited, produces magnetic attraction through the stationary core to attract the movable core along a given travel path to one of open and close electric contacts.

The stationary core includes a disc assembly and a core body, the core body having opposed ends, a base, a boss, and an outer shoulder formed between the base and the boss. The base has an end that is one of the opposed ends which faces the stationary core. The boss has an end that is the other of the opposed ends which is away from the movable core across the base. The disc assembly is made of a stack of annular plate members superposed on each other in a thickness-wise direction thereof and has a fitting hole extending through a thickness of the stack. Each of the annular plate members has a circular center hole which defines the fitting hole of the disc assembly. The disc assembly is fit at the fitting hole on the boss. At least a portion of an edge of the end of the boss is plastically deformed outward in a radius direction of the boss to create an elastic nip which retains the stack of the annular plate members of the disc assembly between the edge and the outer shoulder of the core body, thereby ensuring the stability of joint between the disc assembly and the core body, that is, the stability in operation of the magnetic switch.

In the preferred mode of the invention, an outermost one of the annular plate members of the disc assembly which is located far away from the base has a shear drop on an inner circumferential edge of the center hole thereof which has arisen from punching out the circular center holes in the stack of the annular plate members in the thickness-wise direction thereof. The plastically deformed edge of the end of the boss is in abutment with the shear drop of the outermost one of the annular plate members, thereby ensuring the stability of joint between the disc assembly and the core body even when the center holes of the plate members vary in inner diameter, have distortions, or lack in sheared area thereof.

The outermost one of the annular plate members of the disc assembly which is located far away from the base may alternatively have a chamfered surface formed on an inner circumferential edge of the center hole thereof. The plastically deformed edge of the end of the boss is in abutment with the chamfered surface of the outermost one of the annular plate members, thereby ensuring the stability of joint between the disc assembly and the core body even when the center holes of the plate members vary in inner diameter, have distortions, or lack in sheared area thereof.

According to the seventh aspect of the invention, there is provided a magnet switch which comprises: (a) a stationary core; (b) a movable core; and (c) a magnetic coil that, when excited, produces magnetic attraction through the stationary core to attract the movable core along a given travel path to one of open and close electric contacts.

The stationary core includes a disc assembly and a core body. The core body has opposed ends, a base, a boss, and an outer shoulder formed between the base and the boss. The base has an end that is one of the opposed ends which faces the stationary core. The boss has an end that is the other of the opposed ends which is located away from the movable core across the base. The disc assembly is made of a stack of annular plate members superposed on each other in a thickness-wise direction thereof and has a fitting hole extending through a thickness of the stack. Each of the annular plate members has a circular center hole which defines the fitting hole of the disc assembly. The disc assembly is fit at the fitting hole on the boss. The length of the boss between the outer shoulder and the end of the boss is greater than a thickness of the disc assembly. At least a portion of an edge of the end of the boss is plastically deformed outward in a radius direction of the boss to create an elastic nip which retains the stack of the annular plate members of the disc assembly between the at least the portion of the edge and the outer shoulder of the core body, thereby ensuring the stability of joint between the disc assembly and the core body, that is, the stability in operation of the magnetic switch.

In the preferred mode of the invention, an outermost one of the annular plate members of the disc assembly which is located far away from the base has a shear drop on an inner circumferential edge of the center hole thereof which has arisen from punching out the circular center holes in the stack of the annular plate members in the thickness-wise direction thereof. The plastically deformed portion of the edge of the end of the boss is in abutment with the shear drop of the outermost one of the annular plate members, thereby ensuring the stability of joint between the disc assembly and the core body even when the center holes of the plate members vary in inner diameter, have distortions, or lack in sheared area thereof.

The outermost one of the annular plate members of the disc assembly which is located far away from the base may alternatively have a chamfered surface formed on an inner circumferential edge of the center hole thereof, and wherein the plastically deformed portion of the edge of the end of the boss is in abutment with the chamfered surface of the outermost one of the annular plate members, thereby ensuring the stability of joint between the disc assembly and the core body even when the center holes of the plate members vary in inner diameter, have distortions, or lack in sheared area thereof.

According to the eighth aspect of the invention, there is provided a magnet switch which comprises: (a) a stationary core; (b) a movable core; and (c) a magnetic coil that, when excited, produces magnetic attraction through the stationary core to attract the movable core along a given travel path to one of open and close electric contacts.

The stationary core includes a disc assembly and a core body. The core body has opposed ends, a base, a boss, and an outer shoulder formed between the base and the boss. The base has an end that is one of the opposed ends which faces the stationary core. The boss has an end that is the other of the opposed ends which is located away from the movable core across the base. The disc assembly is made of a stack of annular plate members superposed on each other in a thickness-wise direction thereof and has a fitting hole extending through a thickness of the stack. Each of the annular plate members has a circular center hole which defines the fitting hole of the disc assembly. The disc assembly is fit at the fitting hole on the boss. An outermost one of the annular plate members of the disc assembly which is located far away from the base has a shear drop on an inner circumferential edge of the center hole thereof which has arisen from punching out the circular center holes in the stack of the annular plate members in the thickness-wise direction thereof. At least a portion of an edge of the end of the boss is plastically deformed outward in a radius direction of the boss, so that the plastically deformed portion of the edge is in abutment with the shear drop of the outermost one of the annular plate members, thereby creating an elastic nip which retains the stack of the annular plate members of the disc assembly between the plastically deformed portion of the edge and the outer shoulder of the core body. This ensures the stability of joint between the disc assembly and the core body even when the center holes of the plate members vary in inner diameter, have distortions, or lack in sheared area thereof.

According to the ninth aspect of the invention, there is provided a magnet switch which comprises: (a) a stationary core; (b) a movable core; and (c) a magnetic coil that, when excited, produces magnetic attraction through the stationary core to attract the movable core along a given travel path to one of open and close electric contacts.

The stationary core includes a disc assembly and a core body, the core body having opposed ends, a base, a boss, and an outer shoulder formed between the base and the boss. The base has an end that is one of the opposed ends which faces the stationary core. The boss has an end that is the other of the opposed ends which is located away from the movable core across the base. The disc assembly is made of a stack of annular plate members superposed on each other in a thickness-wise direction thereof and has a fitting hole extending through a thickness of the stack. Each of the annular plate members has a circular center hole which defines the fitting hole of the disc assembly. The disc assembly is fit at the fitting hole on the boss. An outermost one of the annular plate members of the disc assembly which is located far away from the base has a chamfered surface formed on an inner circumferential edge of the center hole thereof. An least a portion of an edge of the end of the boss is plastically deformed outward in a radius direction of the boss, so that the plastically deformed portion of the edge is in abutment with the chamfered surface of the outermost one of the annular plate members, thereby creating an elastic nip which retains the stack of the annular plate members of the disc assembly between the plastically deformed portion of the edge and the outer shoulder of the core body. This ensures the stability of joint between the disc assembly and the core body even when the center holes of the plate members vary in inner diameter, have distortions, or lack in sheared area thereof.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 10(*b*) is a plane view which illustrates the disc assembly of FIG. 9 after diametrically opposed portions of an edge of a magnetic core is staked;

FIG. 12(*b*) is a longitudinal sectional view, as taken along the line A-A in FIG. 12(*a*), which illustrates an internal structure of the magnetic core;

FIG. 14(*b*) is a sectional view, as taken along the line B-B in FIG. 14(*a*);

DESCRIPTION OF THE PREFERRED EMBODIMENTS

Figure 1:
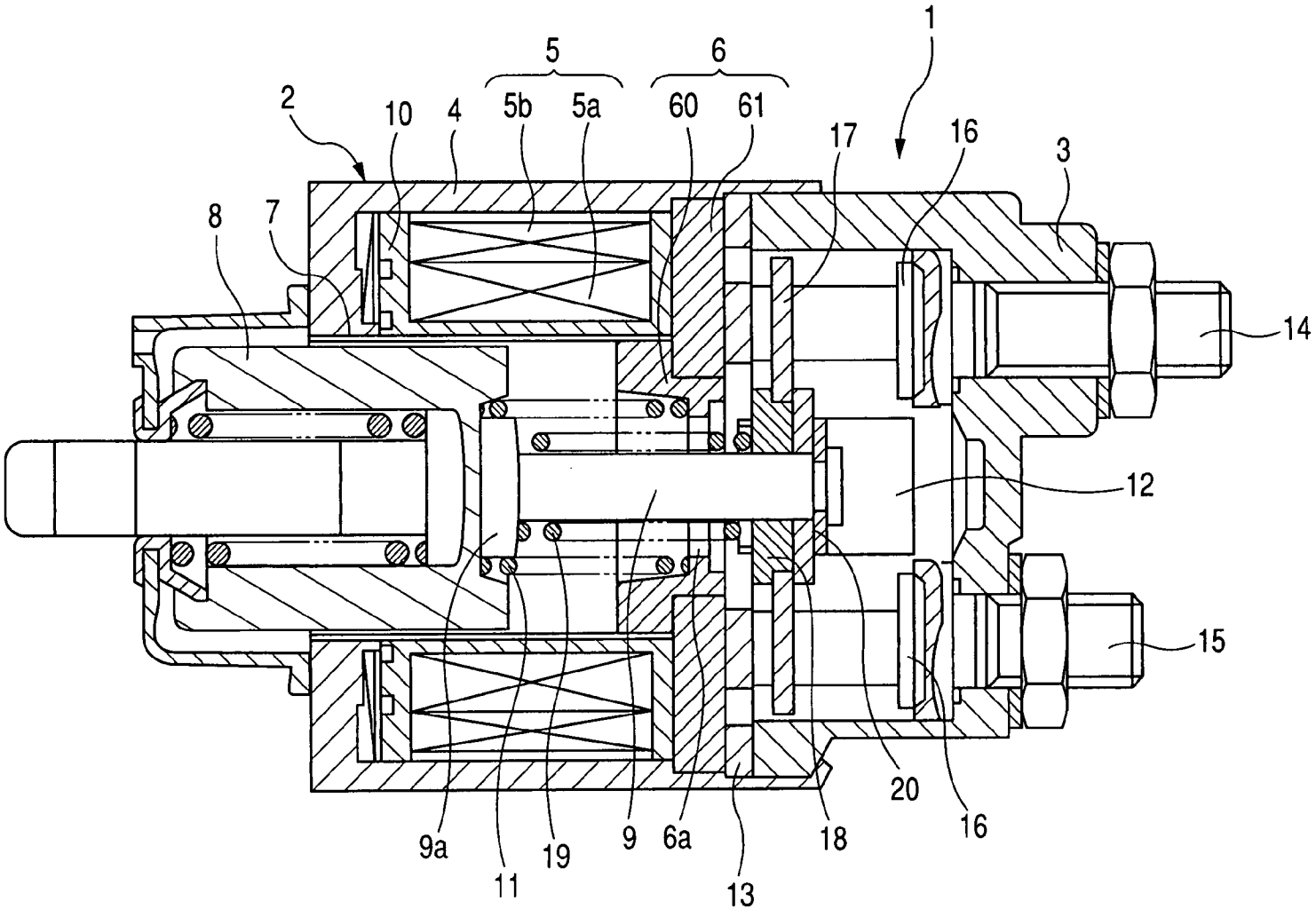
FIG. 1 is a longitudinal sectional view which shows a direct-acting magnet switch for use in an engine starter according to the first embodiment of the invention.

Referring to the drawings, wherein like reference numbers refer to like parts in several views, particularly to FIG. 1, there is shown a direct-acting magnet switch 1 for engine starters according to the first embodiment of the invention. The magnet switch 1 is designed to open or close main contacts, as will be described later in detail, installed in a motor energizing circuit, as will also be referred to as a motor circuit below, to turn on an electric motor of the engine starter to start automotive internal combustion engines. The magnet switch 1 includes a solenoid assembly 2 serving as an electromagnet and a switch cover 3 joined to the solenoid assembly 2.

The solenoid assembly 2 consists of a switch casing 4 serving as a yoke, a magnetic coil 5 disposed inside the switch casing 4, a stationary magnetic core 6 to be magnetized upon excitation of the coil 5, a plunger 8 functioning as a movable core disposed slidably inside the coil 5, and a shaft (also called a plunger rod) 9 disposed to be movable along with the plunger 8.

The coil 5 is made up of an attraction coil 5*a* and a hold coil 5*b* which are wound around a coil bobbin 10 in the form of two layers. The attraction coil 5*a* works to produce magnetic attraction to pull the plunger 8. The hold coil 5*b* works to produce magnetic force which holds or retains the plunger 8 as pulled by the attraction coil 5*a*.

The stationary magnetic core 6 is made of a soft magnetic material such as soft-ion and serves to form a magnetic circuit with an air gap along with the switch casing 4 and the plunger 8. The magnetic circuit magnetically links with the coil 5. The switch casing 4 also functions as a magnetic core, i.e., a stationary magnetic path-forming material, but a stationary member extending perpendicular to the axis of the coil 5 adjacent the end of the coil 5 closer to the movable contact 17 is defined herein as the magnetic core 6. The structure of the magnetic core 6 will be described later in detail.

The plunger 8 is disposed inside the sleeve 7 in alignment with the stationary magnetic core 6. A return spring 11 is interposed between the magnetic core 6 and the plunger 8 to urge the plunger 8 away from the magnetic core 6 (i.e., the left direction, as viewed in FIG. 1), thereby defining an air gap between the magnetic core 6 and the plunger 8.

The shaft 9 has formed on one of ends thereof a flange 9*a* secured to an end of the plunger 8 so that it is movable along with the plunger 8. The shaft 9 also has the other end extending through a center hole 6*a* formed on the magnetic core 6 inside a contact chamber 12 formed in the switch cover 3.

The switch cover 3 is made of, for example, resin and disposed in abutment with the magnetic core 6 through a rubber gasket 13. The switch cover 3 is joined to the end of the switch casing 4 by crimping a peripheral end of the switch casing 4 to define the contact chamber 12 between an inner wall of the switch cover 3 and the rubber gasket 13.

The main contacts, as described above, include a pair of fixed contacts 16 and a movable contact 17. The fixed contacts 16 are coupled with the motor circuit through external terminals 14 and 15 installed in the switch cover 3. The terminals 14 and 15 may be made of a typical bolt. The movable contact 17 is moved to establish or break an electric connection between the fixed contacts 16.

The movable contact 17 is secured to the end of the shaft 9 through an electric insulator 18 within the contact chamber 12 and urged by a contact spring 19 disposed between the flange 9*a* of the shaft 9 and the insulator 18 toward the top of the shaft 9 (i.e., the right as viewed in FIG. 1) into constant abutment with a stopper 20 fitted on the end of the shaft 9.

Figure 2:
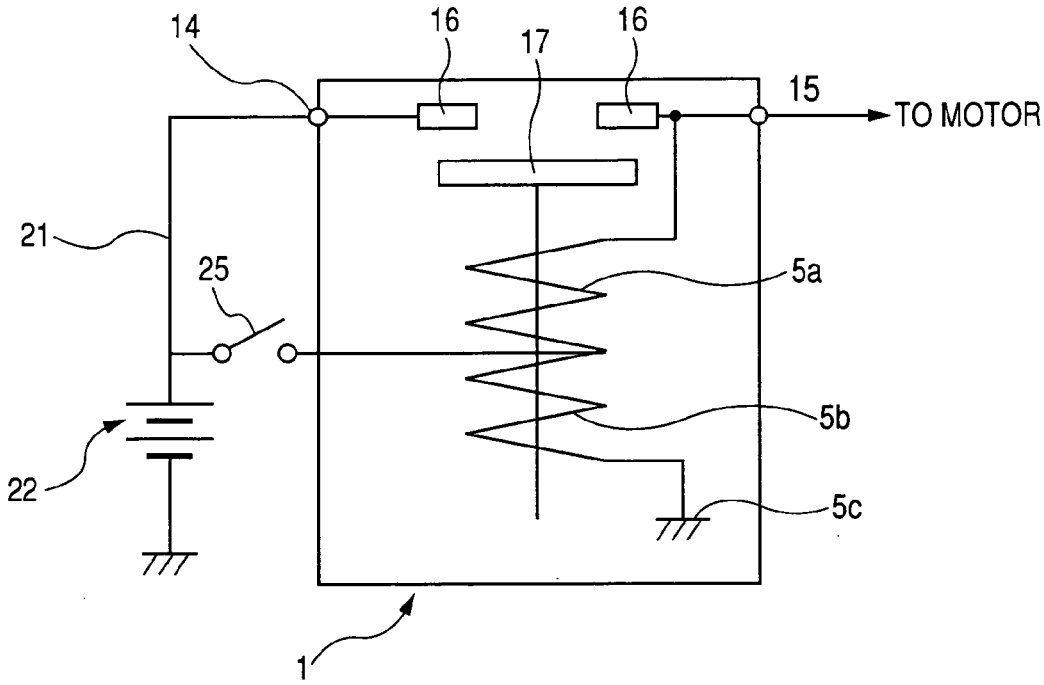
FIG. 2 is a circuit diagram which shows an electric structure of the magnet switch of FIG. 1.

The external terminals 14 and 15 are a typical B-terminal and a typical M-terminal which are connected to a storage battery 21, as illustrated in FIG. 2, mounted in an automotive vehicle.

In operation of the magnetic switch 1, when a start switch 25, as illustrated in FIG. 2, is turned on to excite the coil 5, it will cause the magnetic core 6 to be magnetized to create a magnetic attraction between a core body 60 of the magnetic core 6 and the plunger 8, thereby moving the plunger 8 to the core body 60 (i.e., the left, as viewed in FIG. 6) against the spring pressure of the return spring 11. The movement of the plunger 8 causes the shaft 9 to be pushed to bring the movable contact 17 into abutment with the fixed contacts 16. The plunger 8 is further moved against the pressure, as produced by a contact press spring 19, and abuts the end of the core body 60, so that it stops. This causes the compressive pressure, as produced by the contact press spring 19, to be exerted on the movable contact 17 to secure the stability in abutment of the movable contact 17 with the fixed contacts 16, thereby starting the supply of electric power from the battery 22 to the electric motor installed in the engine starter. After the start-up of the engine, the start switch 25 is turned off. This causes the coil 5 to be deenergized so that the magnetic attraction disappears. The plunger 8 is then pushed backward by the spring pressure of the return spring 11, thereby moving the movable contact 17 away from the fixed contacts 16 to break the electric connection between the fixed contacts 16 to stop the supply of electric power to the motor of the engine starter.

Figure 3:
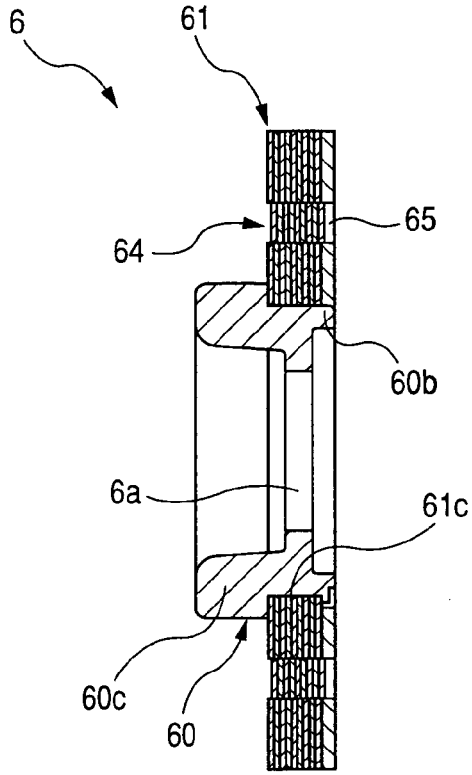
FIG. 3 is a longitudinal sectional view which illustrates an internal structure of a disc assembly installed in the magnet switch of FIG. 1.
Figure 4:
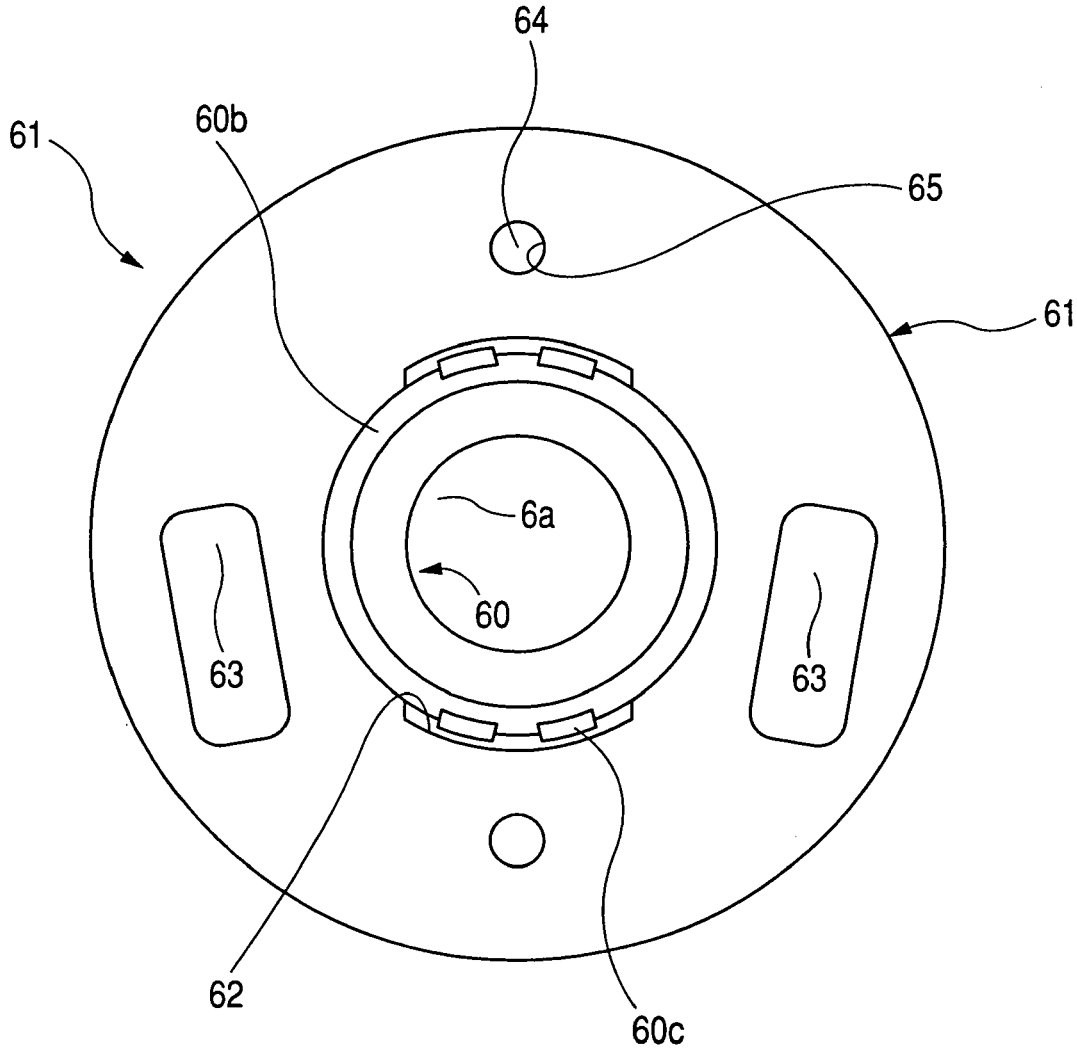
FIG. 4 is a front view which illustrates a magnetic core made up of a base and a disc assembly, as viewed from a rubber gasket installed in the magnet switch of FIG. 1.
Figure 5:
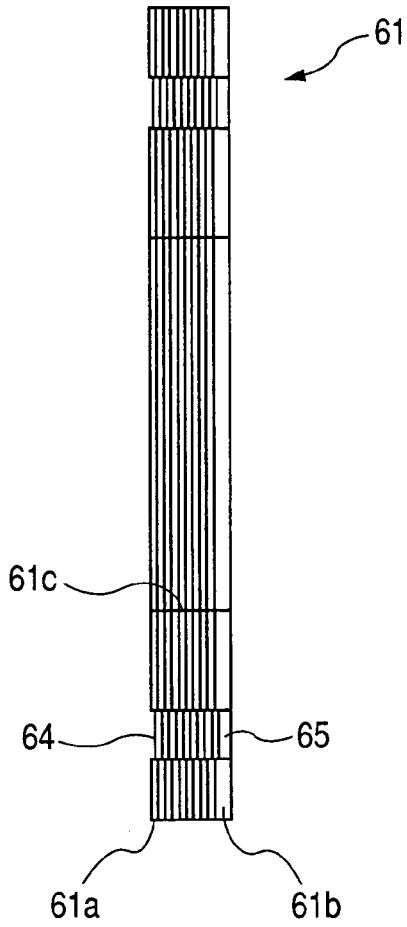
FIG. 5 is a longitudinal sectional view which illustrates a disc assembly made up of a stack of annular sheets and an annular plate installed in the magnet switch of FIG. 1.

The structure of the magnetic core 6 will be described below in detail with reference to FIGS. 3 and 4.

The magnetic core 6 is made up of the core body 60 and a disc assembly 61. The core body 60 is, as described above, also called a core body and of a hollow cylindrical shape. The core body 60 is disposed in alignment with the plunger 8 and has one of opposed ends oriented to the plunger 8. The disc assembly 61 is fit on an outer peripheral portion of the core body 60 and faces the end of the coil 5.

The core body 60 is, as clearly illustrated in FIG. 1, made of a hollow cylinder and has the center hole 6*a*. The core body 60 is made up of a small-diameter portion 60*b* (also called a boss) on which the disc assembly 61 is fit and a large-diameter portion fit on the inner periphery of the sleeve 7. The small-diameter portion 60*b* is press-fit on the inner periphery of a through hole 61*c* of the disc assembly 61.

The disc assembly 61 is made of a stack of soft-iron made thin sheets (i.e., plate members) of the same size. The disc assembly 61 is retained between the end wall of the bobbin 10 of the coil 5 and the switch cover 3. Specifically, the rubber gasket 13 serving as a soft-seal is placed in abutment with the end surface of the disc assembly 61 closer to the switch cover 3 and extends radially of the disc assembly 61. The rubber gasket 13 is nipped at the outer peripheral edge thereof between the outer periphery of the disc assembly 61 and the open end of the switch cover 3. The switch casing 4 is bent or crimped at the peripheral edge thereof and joined to the periphery of the switch cover 3.

The disc assembly 61 has formed therein two rectangular coil lead openings 63 through which terminal leads of the coil 5 extend to the right, as viewed in FIG. 6, and also has two pairs of protrusions or tabs, as will be described later in detail.

The disc assembly 61 is made up of a stack of nine (9) thin annular sheets 61*a* and an annular plate 61*b* which is greater in thickness than the sheets 61*a* and faces the rubber gasket 13. Each of the sheets 61*a* and the plate 61*b* has a pair of openings of the same size which define the coil lead openings 63. The sheets 61*a* and the plate 61*b* are identical with each other in angular interval between the pair of the openings in the circumferential direction thereof. Specifically, the sheets 61*a* and the plate 61*b* are laid to overlap or superposed on each other so that the openings of the sheets 61*a* and the plate 61*b* coincide with each other to define the two coil lead openings 63. Each of the sheets 61*a* has two positioning embossed protrusions 64 which project toward the rubber gasket 13 and are diametrically opposed to each other across the center of the sheet 61*a*, that is, located at 180° away from each other and at substantially 90° away from the coil lead openings 63 in the circumferential direction of the sheet 61*a*. The embossed protrusions 64 are fit in each other in alignment to hold the sheets 61*a* from rotating in the circumferential direction thereof. The plate 61*b* has two holes 65 spaced at the same angular interval as that of the embossed protrusions 64. Specifically, the embossed protrusions 64 of the rightmost one of the sheets 61*a*, as viewed in FIG. 6, are press-fit in the holes 65 of the plate 61*b* to complete the coil lead openings 63. The plate 61*b* has a thickness which is great enough to prevent the protrusions 64 of the rightmost one of the sheets 61*a* fit in the holes 65 from abutting the rubber gasket 13.

Figure 7:
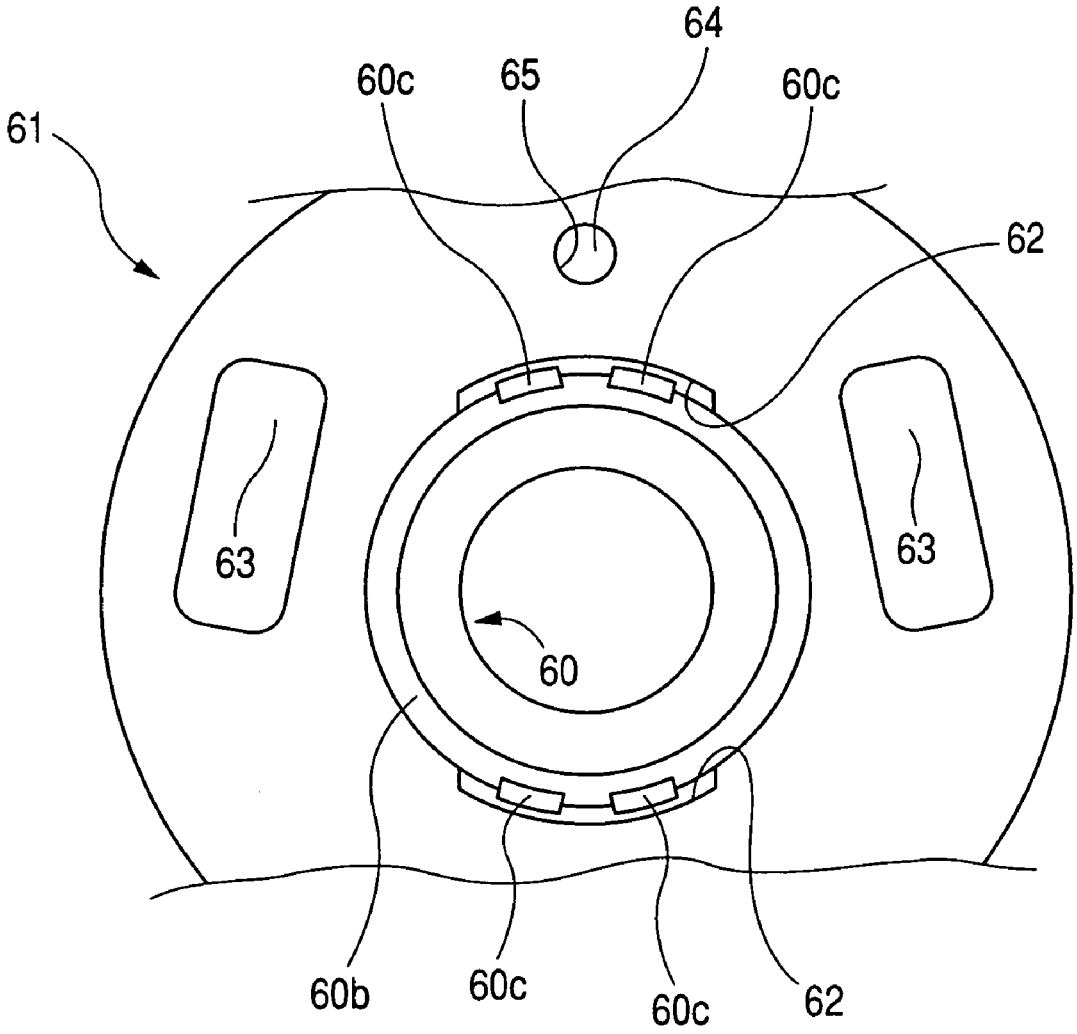
FIG. 7 is a partially enlarged front view which illustrates the magnetic core made up of a base and a disc assembly installed in the magnetic switch of FIG. 1.

The annular plate 61*b* has arc-shaped recesses 62 formed in an inner edge thereof defining the center hole 61*c* in which the small-diameter portion 60*b* of the core body 60 is fit. The arc-shaped recesses 62 are opposed diametrically to each other across the center of the annular plate 61*b*. The small-diameter portion 60*b* of the core body 60 has two pairs of tabs 60*c* extending outwardly in the radius direction thereof. The tabs 60*c* are plastically deformed or bent outward in a radius direction of the core body 60 to form an elastic nip which holds the stack of sheets 61*a* around the periphery of the small-diameter portion 60*b* of the core body 60. The tabs 60*c* are, as clearly illustrated in FIG. 7, located in the arc-shaped recesses 62 without protruding outside the plate 61*b* toward the rubber gasket 13. The plate 61*b* has the thickness which is great enough to prevent the tabs 60*c* from protruding outwardly toward the rubber gasket 13. Each of the arc-shaped recesses 62 has a length which extends circumferentially of the plate 61*b* and is great enough to place a corresponding one of the pairs of tabs 60 therewithin.

The tabs 60*c* are, as described above, plastically deformed to hold the stack of the sheets 61*a* firmly, thereby ensuring the degree of joining of the sheets 61*a* to the core body 60 which is great enough to withstand a large-scale physical impact or vibration transmitted from outside the disc assembly 61 without causing the damage to the embossed protrusions 64 and the rubber gasket 13.

The production and installation of the disc assembly 61 on the core body 60 will be described below.

The coil lead openings 63, the holes 65, the center hole 61*c*, and the arc-shaped recesses 62 of the plate 61*b* are formed by a press. Similarly, the embossed protrusions 64 of each of the annular sheets 61*a* are formed by the press.

The annular sheets 61*a* are arranged in the form of the stack so that the embossed protrusions 64 coincide with each other. Each of the protrusions 64 is press-fit in the adjacent one. The protrusions 64 of the rightmost one of the sheets 61*a*, as viewed in FIG. 6, is press-fitted in the holes 65 of the plate 61*b* to make or complete the disc assembly 61. Next, the small-diameter portion 60*b* of the core body 60 is press-fitted in the center hole 61*c* of the disc assembly 61. The tabs 60*c* of the small-diameter portion 60*b* are elastically bent outward to fix the disc assembly 61 firmly to the core body 60. The reference number 60*d* in FIG. 6 indicates an outer annular shoulder of the core body 60 with which the disc assembly 61 is elastically urged by the tabs 60*c* into constant abutment of the leftmost one of the sheets 61*a*, as viewed in FIG. 6. Specifically, the tabs 60*c* are bent to create an elastic nip which holds the stack of the annular sheets 61*a* between themselves and the shoulder 60*d* to establish a firm joint of the disc assembly 61 to the core body 60.

The structure of the magnetic switch 1 may be modified as described below.

The plate 61*b* of the disc assembly 61 facing the rubber gasket 13 may alternatively be made up of a stack of a plurality of annular sheets which has a total thickness greater than that of the sheets 61*a*.

Figure 6:
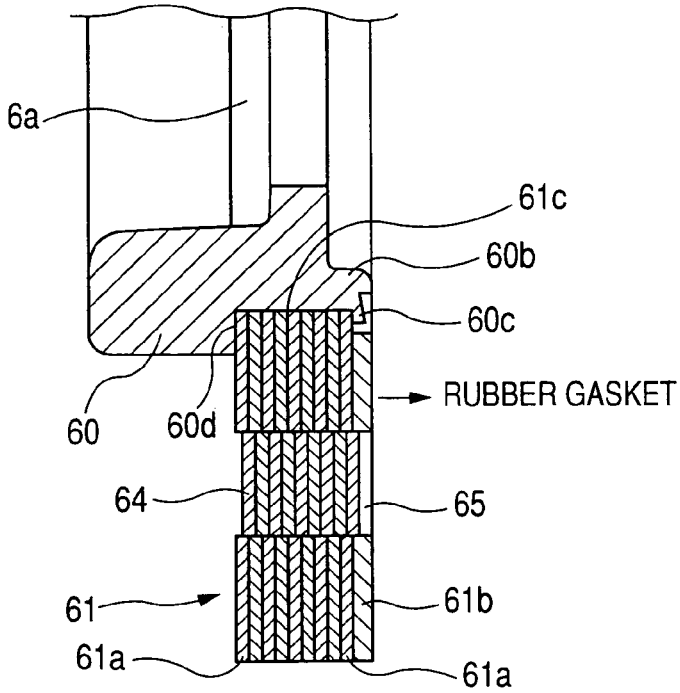
FIG. 6 is a partially enlarged sectional view which illustrates a magnetic core consisting of a base and the disc assembly shown in FIGS. 3 to 5.

The plate 61*b* of the disc assembly 61 may alternatively be disposed on the leftmost one of the sheets 61*a*, as viewed in FIG. 6, closer to the coil bobbin 10. This arrangement also avoids the local concentration of stress arising from the protrusions 64 at the end wall of the coil bobbin 10. The arc-shaped recesses 62 need to be formed in the rightmost one of the sheets 61*a*, as viewed in FIG. 6, instead of in the annular plate 61*b*.

Instead of the arc-shaped recesses 62 of the plate 61*b*, the center hole 61*c* may be increased in size or diameter not to interfere the tabs 60*c* physically.

Figure 8:
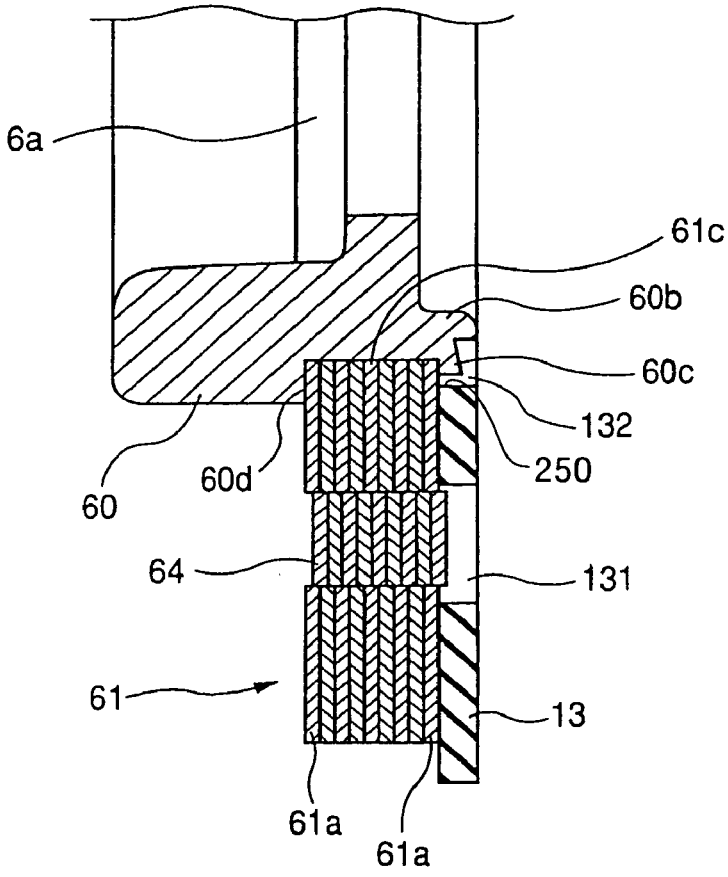
FIG. 8 is a partially enlarged sectional view which illustrates a modification of the magnetic core of FIG. 6 according to the second embodiment of the invention.

FIG. 8 illustrates the disc assembly 61 according to the second embodiment of the invention.

The disc assembly 61 is made up only of a stack of nine (9) annular sheets 61*a* which are identical in structure with the ones in the first embodiment illustrated in FIGS. 1 to 7. The rubber gasket 13 has a center hole 250 in which the end of the small-diameter portion 60*b* is disposed. The rubber gasket 13 also has arc-shaped recesses 132 and holes 131 formed therein. The arc-shaped recesses 132 are identical in structure and intended use with the arc-shaped recesses 62 of the annular plate 61*b* of the disc assembly 6 of the first embodiment. Similarly, the holes 131 are identical in structure and intended use with the holes 65 of the disc assembly 6 of the first embodiment. The holes 131 have the diameter great enough to avoid physical interference with the embossed protrusions 64 of the sheets 61*a*. The protrusions 64 and the tabs 60*c* are located not to obstruct the operations of switching parts such as the movable contact 17, etc. Each of the protrusions 64 of the annular sheets 61*a* may be press-fit in the adjacent one.

Figure 9:
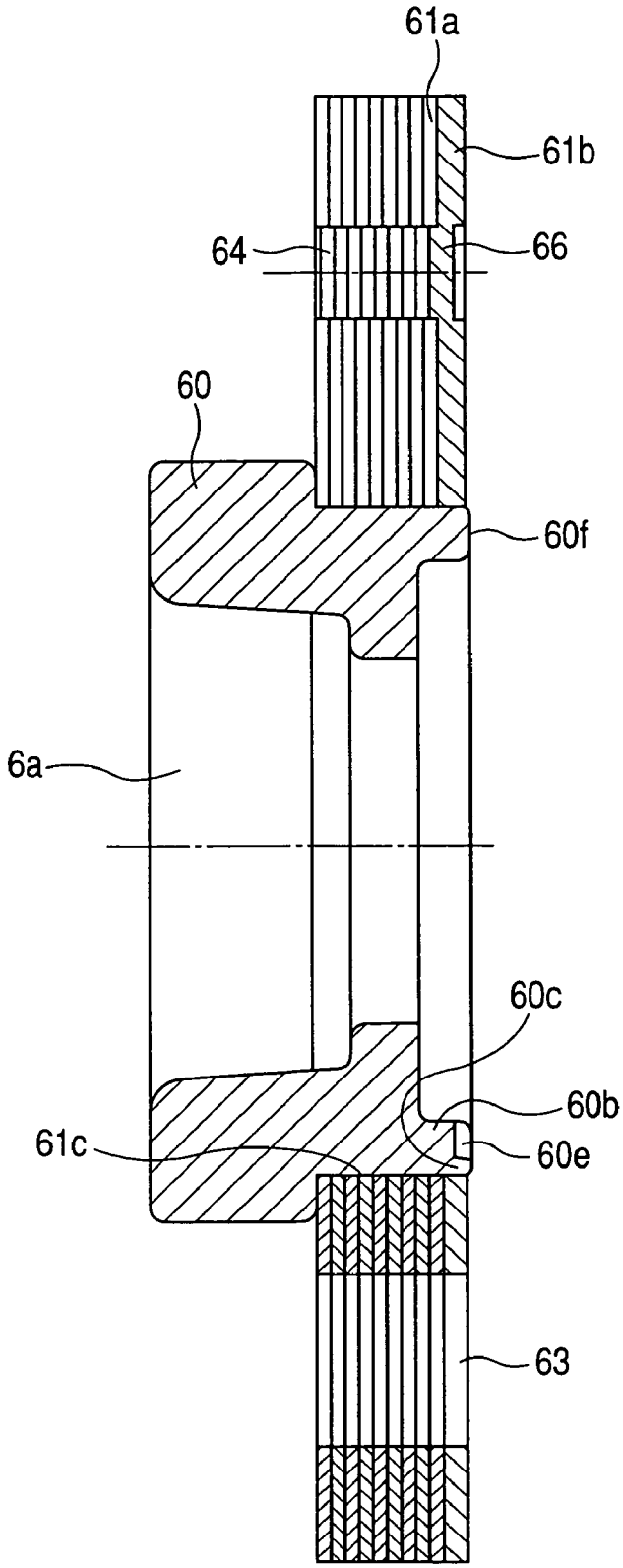
FIG. 9 is a longitudinal sectional view which illustrates an internal structure of a disc assembly installed in the magnet switch of FIG. 1 according to the third embodiment of the invention.
Figure 10A:
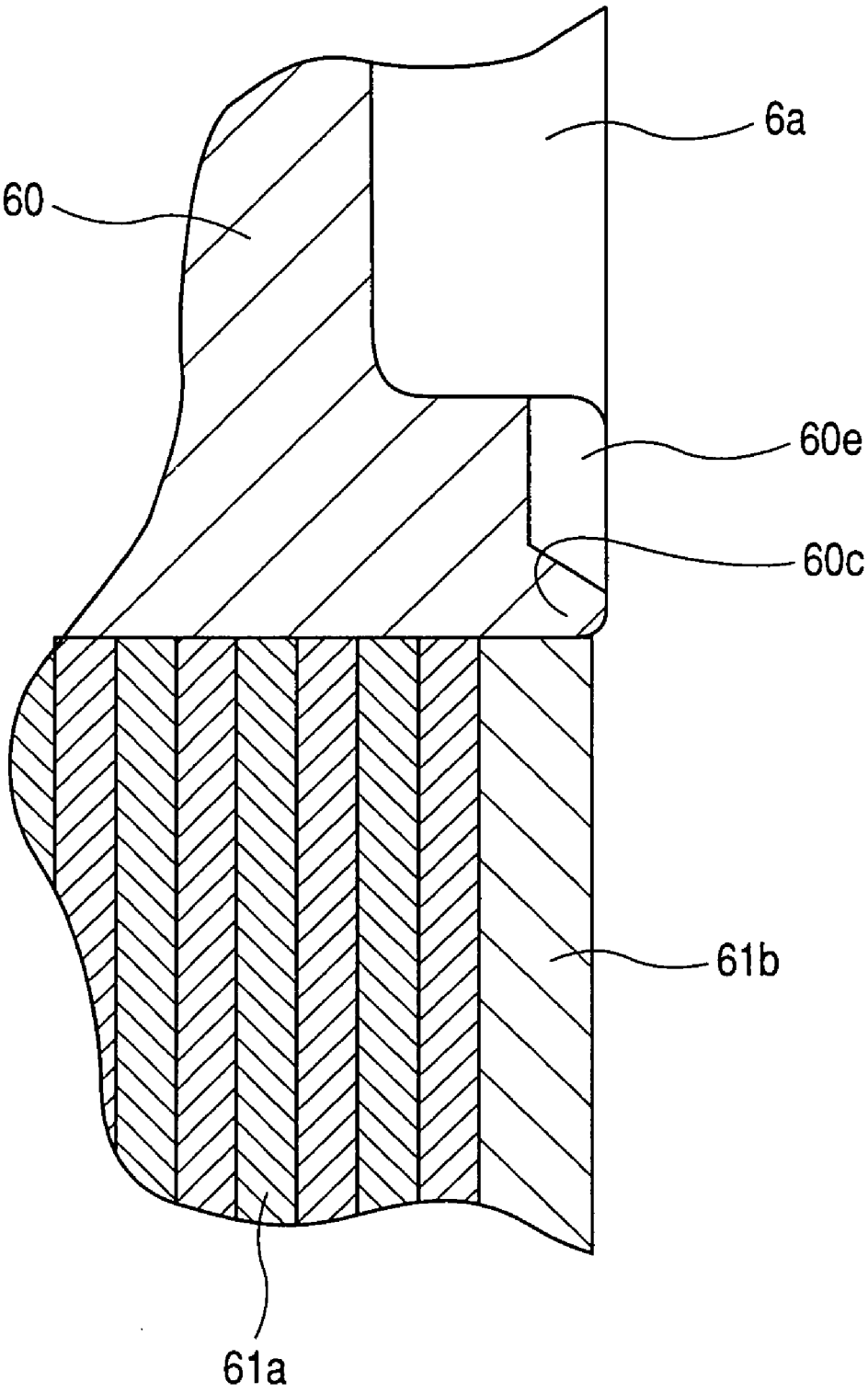
FIG. 10(*a*) is a partially enlarged sectional view, as taken along the ling C-C in FIG. 10(*b*), which illustrates the disc assembly of FIG. 9 before an edge of a magnetic core is staked.
Figure 10B:
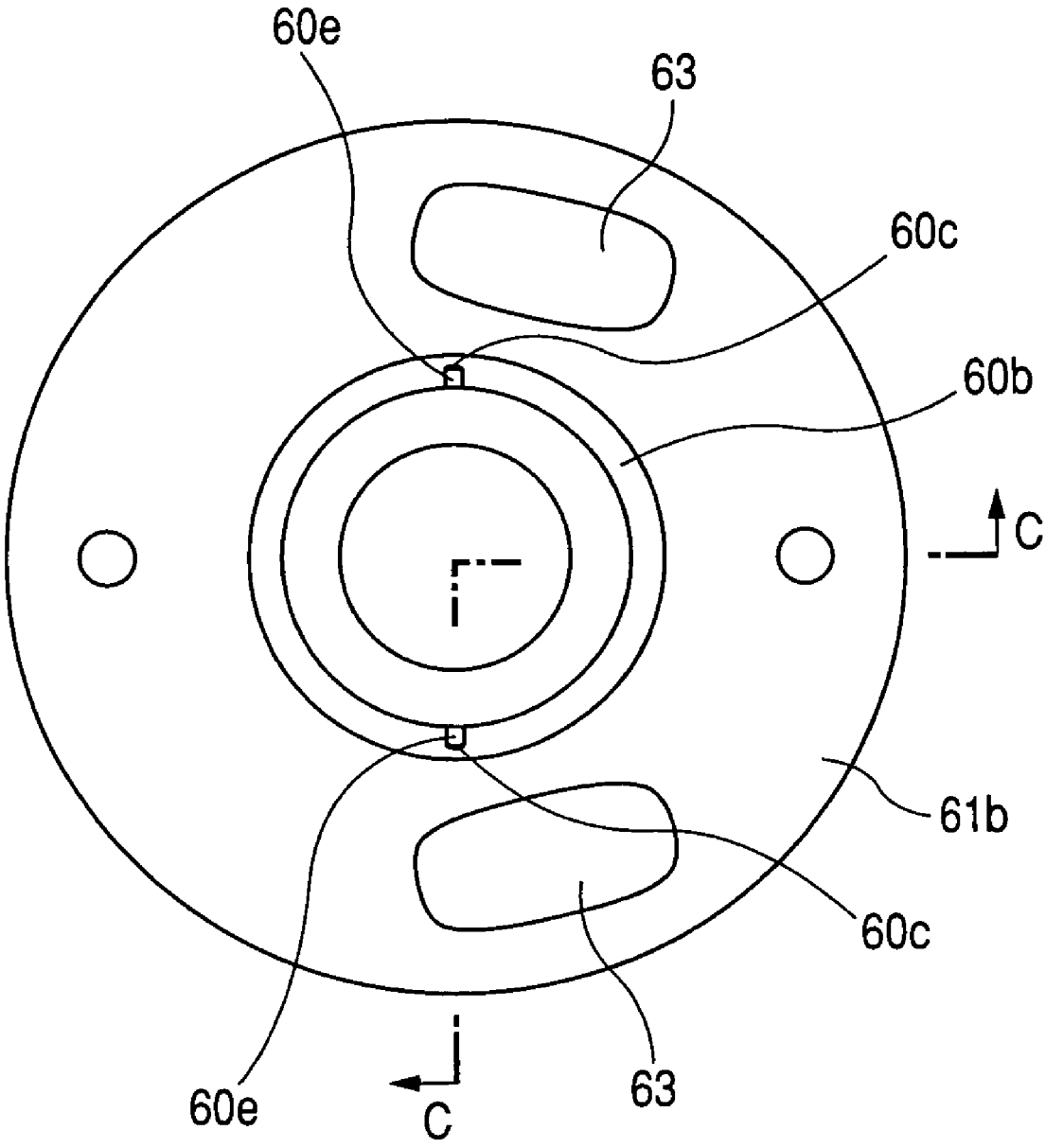

FIGS. 9, 10(*a*), and 10(*b*) illustrate the magnetic core 6 according to the third embodiment of the invention.

The disc assembly 61 is, like in the first embodiment, made up of a stack of nine (9) sheets 61*a* and a plate 61*b* which are superposed on one another in the axial direction of the magnetic core 6. The thickness of the plate 61*b* is two to five times, preferably three to four times that of the sheets 61*b*. This results in a mechanical property balance between the elasticity and the rigidity of the plate 61*b*.

Each of the sheets 61*a*, like in the first embodiment, has two embossed protrusions 64 (only one is shown in FIG. 9 for the brevity of illustration). Each of the protrusions 64, unlike in the first embodiment, projects away from the movable contact 17 (i.e., the left direction, as viewed in the drawing). The protrusions 64 of each of the sheets 61*a* are press-fit in those of the adjacent one in alignment to hold the sheets 61*a* from rotating in the circumferential direction thereof. Similarly, the plate 61*b* has embossed protrusions 66 which are press-fit in recesses formed in the backs of the embossed protrusions 64 of an adjacent one of the sheets 61*a*. This structure eliminates the need for forming the holes such as the holes 65 in the plate 61*b* of the first embodiment, thus resulting in a decrease in machining cost of the disc assembly 61 and an increase in rigidity of the plate 61*b*. The leftmost one of the sheets 61*a* is, as illustrated in FIG. 9, preferably designed to have only recesses in which the protrusions 66 of an adjacent one of the sheets 61*a* are fit. In other words, the leftmost one of the sheets 61*a* is preferably designed to have a flat or even surface (i.e., the left surface, as viewed in the drawing).

The disc assembly 61 is disposed adjacent the end of the switch cover 3 without the rubber gasket 13.

The joint of the disc assembly 61 to the core body 60 of the magnetic core 6 is achieved by elastically pressing or staking tabs 60*c* formed on the corner of the small-diameter portion 60*b* of the core body 60 in the axial direction of the core body 60. Specifically, the core body 60 has the two tabs 60*c* opposed diametrically to each other across the axial center thereof. FIG. 9 shows only the one tab 60*c* for the brevity of illustration. Each of the tabs 60*c* is a protrusion, as clearly illustrated in FIGS. 10(*a*) and 10(*b*), defined on the outer edge or outer corner of the open end 60*f* of the small-diameter portion 60*b* of the core body 60 by forming by a recess 60*e* in a inside area of the end 60*f*. The tabs 60*c* are, as illustrated in FIG. 10(*b*), pressed or flattened plastically using a punch or hammer, so that they may expand in the radial direction of the core body 60 only slightly to press the plate 61*b* outwardly, thereby creating an elastic nip which retains the stack of the sheets 61*a* and the plate 61*b* firmly between the tabs 60*c* and the outer shoulder 60*d* of the core body 60. Instead of the tabs 60*c*, an annular ridge may be formed on the outer edge of the end 60*f* of the small-diameter portion 60*b* of the core body 60.

The production of the disc assembly 61 is achieved in substantially the same manner as that in the first embodiment except as discussed below.

The protrusions 64 and 66 are all formed simultaneously by placing the stack of the sheets 61*a* and the plate 61*b* on a die and punching out them in a single action. This also achieves the fitting of the protrusions 64 and 66 on each other to complete the disc assembly 61.

In the case where it is required to make the disc assembly 61 to be larger in size, the fabrication thereof may be achieved in a sequence of three steps of punching the protrusions 64 of a stack of the six sheets 61*a*, punching the protrusions 64 and 66 of a stack of the remaining four sheets 61*a* and the plate 61*b*, and press-fitting the protrusions 64 of one of the stacks in those of the other.

The structure of the disc assembly 61 with the thicker plate 61*b* has the following advantages.

When the plunger 8 hits the core body 60, the impact will be transmitted to the sheets 61*a* in sequence and finally reach the plate 61*b*. Each of the sheets 61*a* transfers the impact, as inputted thereto, to the adjacent one, so that each of the sheets 61*a* is susceptible to physical deformation. The plate 61*b* the impact finally reaches is, however, susceptible to the physical deformation because there is no object to which the impact is transferred from the plate 61*b*. It is, therefore, advisable that the plate 61*b* be designed to be greater in thickness than the sheets 61*a* to have the rigidity great enough to resist to the physical deformation. The plate 61*b*, as described above, is designed to have the thickness two to five times greater than that of the sheets 61*a*, thereby minimizing the plastic deformation arising from the input of the impact.

The disc assembly 61 is, as described above, made up of a stack of annular metal sheets (i.e., the nine sheets 61*a* and the single plate 61*b*), so that each of the sheets experiences the elastic deformation much greater than when the disc assembly 61 is made of a one-piece soft-steel plate, thus resulting in improved ability to absorb the impact. This means that the kinetic-energy of the plunger 8 is absorbed by the disc assembly 61 through the core body 60 gradually, thereby reducing the impact resulting from the hitting of the movable contact 17 against the fixed contacts 16 to decrease the wear of the contacts 16 and 17 greatly.

Figure 11:
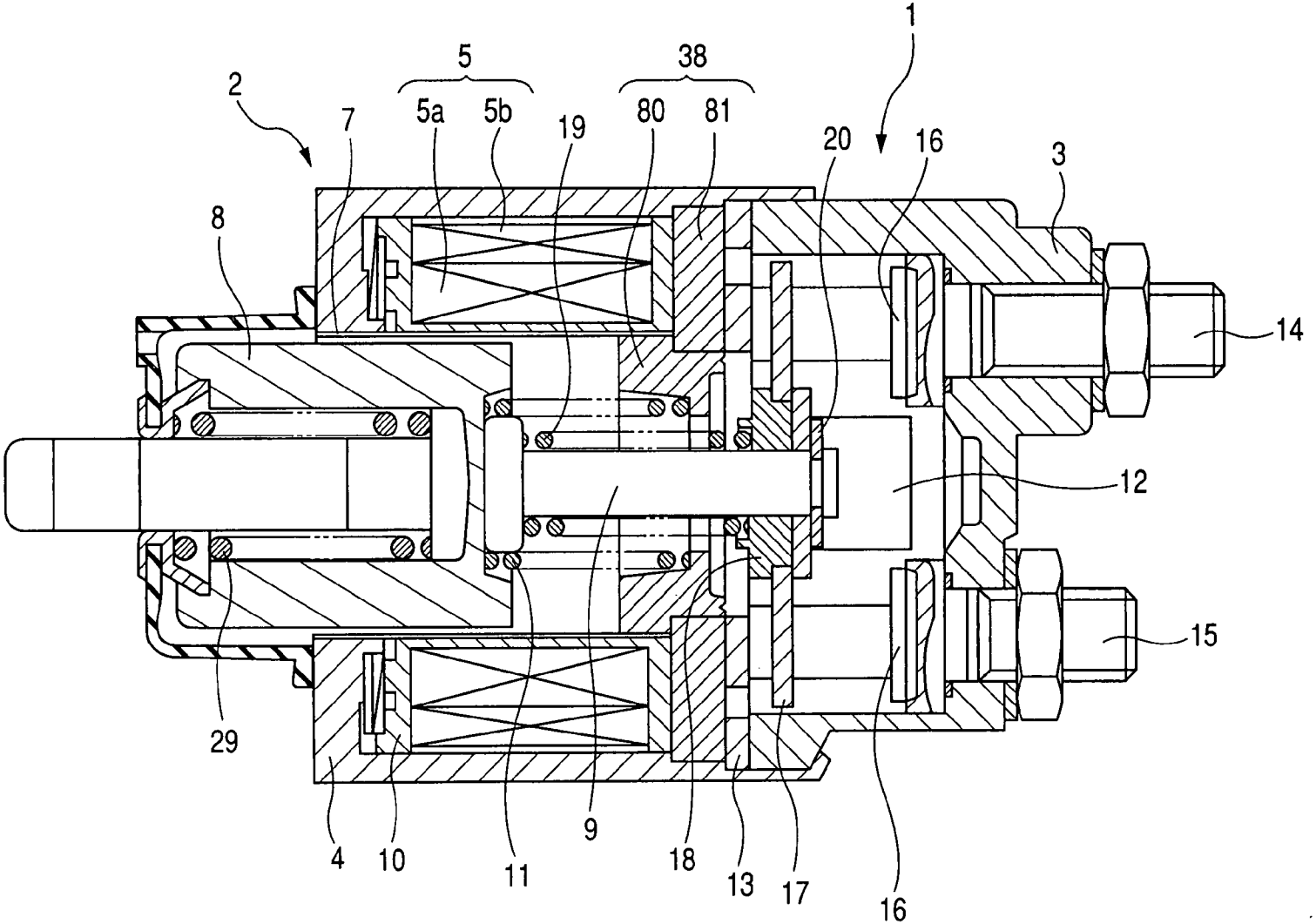
FIG. 11 is a longitudinal sectional view which shows a direct-acting magnet switch for use in an engine starter according to the fourth embodiment of the invention.

FIG. 11 illustrates a magnetic switch 1 according to the fourth embodiment of the invention. The same reference numbers as employed in the first to third embodiments will refer to the same parts, and explanation thereof in detail will be omitted here.

The solenoid assembly 2 consists of a coil 5, a stationary magnetic core 38, a plunger 8 disposed inside the coil 5 through a sleeve 7, a return spring 11 disposed between the core 38 and the plunger 8, and a plunger rod 9 on which a movable contact 17 is retained.

The coil 5 is made up of an attraction coil 5*a* and a hold coil 5*b* which are wound around a coil bobbin 10 in the form of two layers. The attraction coil 5*a* works to produce magnetic attraction to pull the plunger 8. The hold coil 5*b* works to produce magnetic force which holds or retains the plunger 8 as pulled by the attraction coil 5*a*.

The stationary magnetic core 38 is made up of a core body 80 and a disc assembly 81. The core body 80 is disposed inside the sleeve 7 and faces the plunger 8. The disc assembly 81 is retained in abutment of an outer edge thereof with an inner shoulder formed on an inner periphery of the solenoid casing 4 to retain the core body 80.

The plunger 8 is disposed inside the sleeve 7 in alignment with the stationary magnetic core 38. A return spring 11 is interposed between the magnetic core 38 and the plunger 8 to urge the plunger 8 away from the magnetic core 38 (i.e., the left direction, as viewed in FIG. 9), thereby defining an air gap between the core body 80 and the plunger 8 when the magnetic coil 5 is deenergized.

The plunger rod 9 is secured at an end thereof to an end of the plunger 8 so that it is movable along with the plunger 8. The plunger rod 9 also has the other end extending through a center hole formed on the magnetic core 38 inside a contact chamber 12 formed in the switch cover 3.

The switch cover 3 is made of, for example, resin and disposed in abutment with the disc assembly 81 of the magnetic core 38 through a rubber gasket 13. The switch cover 3 is joined to the end of the switch casing 4 by crimping a peripheral end of the switch casing 4.

The external terminal 14 is a typical B-terminal leading to a higher-potential side of the motor circuit (i.e., a storage battery). The external terminal 15 is a typical M-terminal leading to a lower-potential side of the motor circuit (i.e., the motor) through a motor lead (not shown). The external terminals 14 and 15 have heads to which the fixed contacts 16 are affixed.

The movable contact 17 is secured to the end of the plunger rod 9 through an electric insulator 18 within the contact chamber 12 and urged by a contact spring 19 disposed around the periphery of the plunger rod 9 toward the top of the plunger rod 9 (i.e., the right as viewed in FIG. 11) into constant abutment with a stopper 20 fitted on the end of the plunger rod 9. The stopper 20 is implemented by a washer.

The structure of the magnetic core 38 will be described below in detail.

The magnetic core 38 is, as described above, made up of the core body 80 and the disc assembly 81.

The disc assembly 81 is made of a stack of annular sheets 82 of the same size which are pressed against each other as a unit.

Figure 14A:
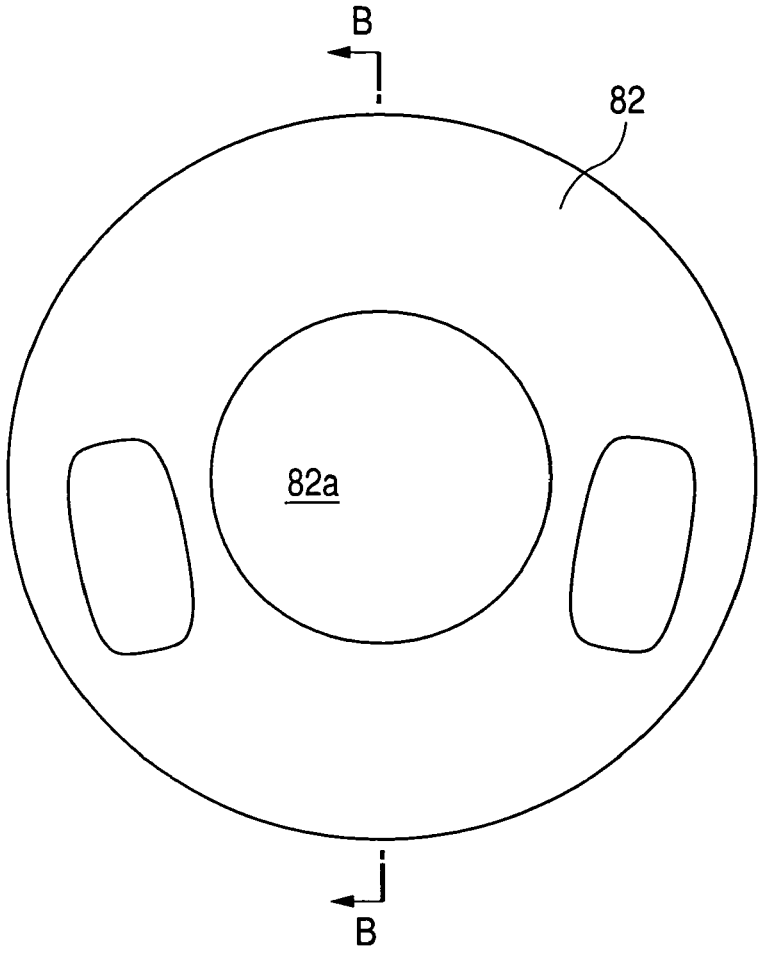
FIG. 14(*a*) is a front view which illustrates a sheet of a disc assembly in the fourth embodiment of the invention.
Figure 14B:
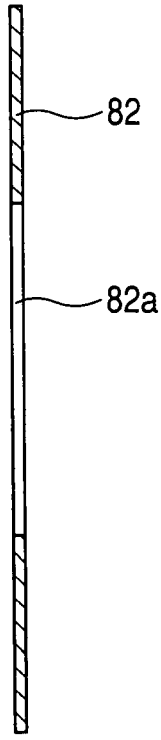

Each of the sheets 82, as illustrated in FIG. 14(*a*), has a circular circumference and is of a ring-shape with a punched out circular center hole 82*a*. FIG. 14(*b*) is a sectional view of the sheet 82, as taken along the line B-B in FIG. 14(*a*).

The disc assembly 81, as clearly illustrated in FIG. 14(*a*), has a through center hole 81*a* and a pair of elongated openings 81*b*. The center hole 81*a* is formed by arraying circular holes 82*a* formed in the sheets 82 in coincidence with each other. The openings 81*b* have terminal leads of the coil 5 passing therethrough toward the right side of the disc assembly 81.

Figure 12B:
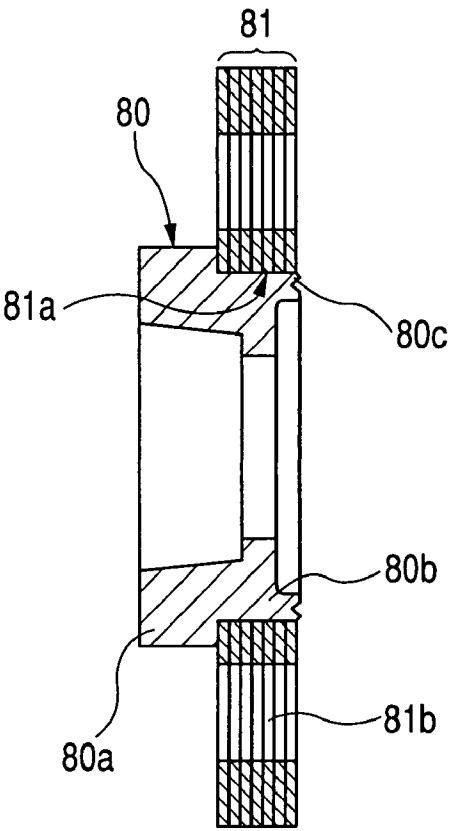
FIG. 12(*a*) is a front view which illustrates a magnetic core of the magnet switch of FIG. 11.
Figure 12A:
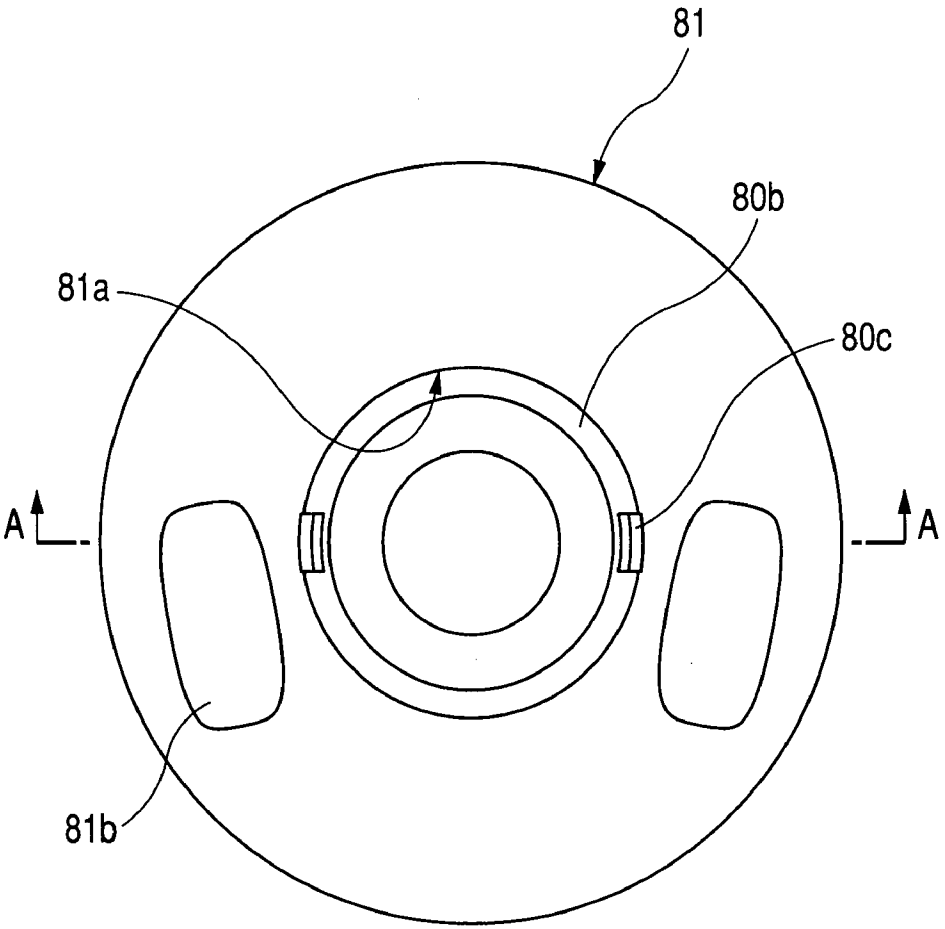
Figure 13:
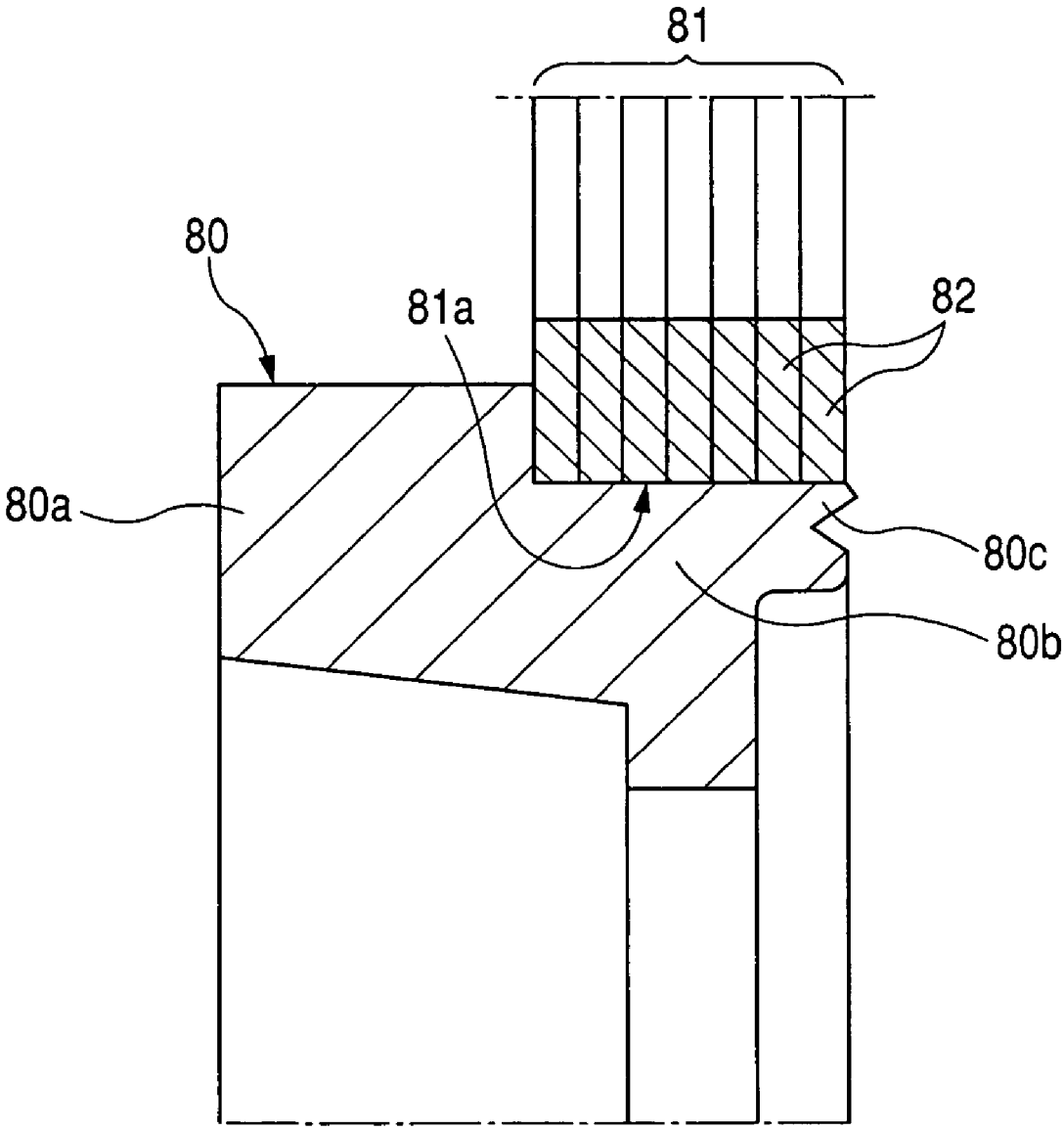
FIG. 13 is a partially enlarged sectional view of FIG. 12(*b*)
Figure 15:
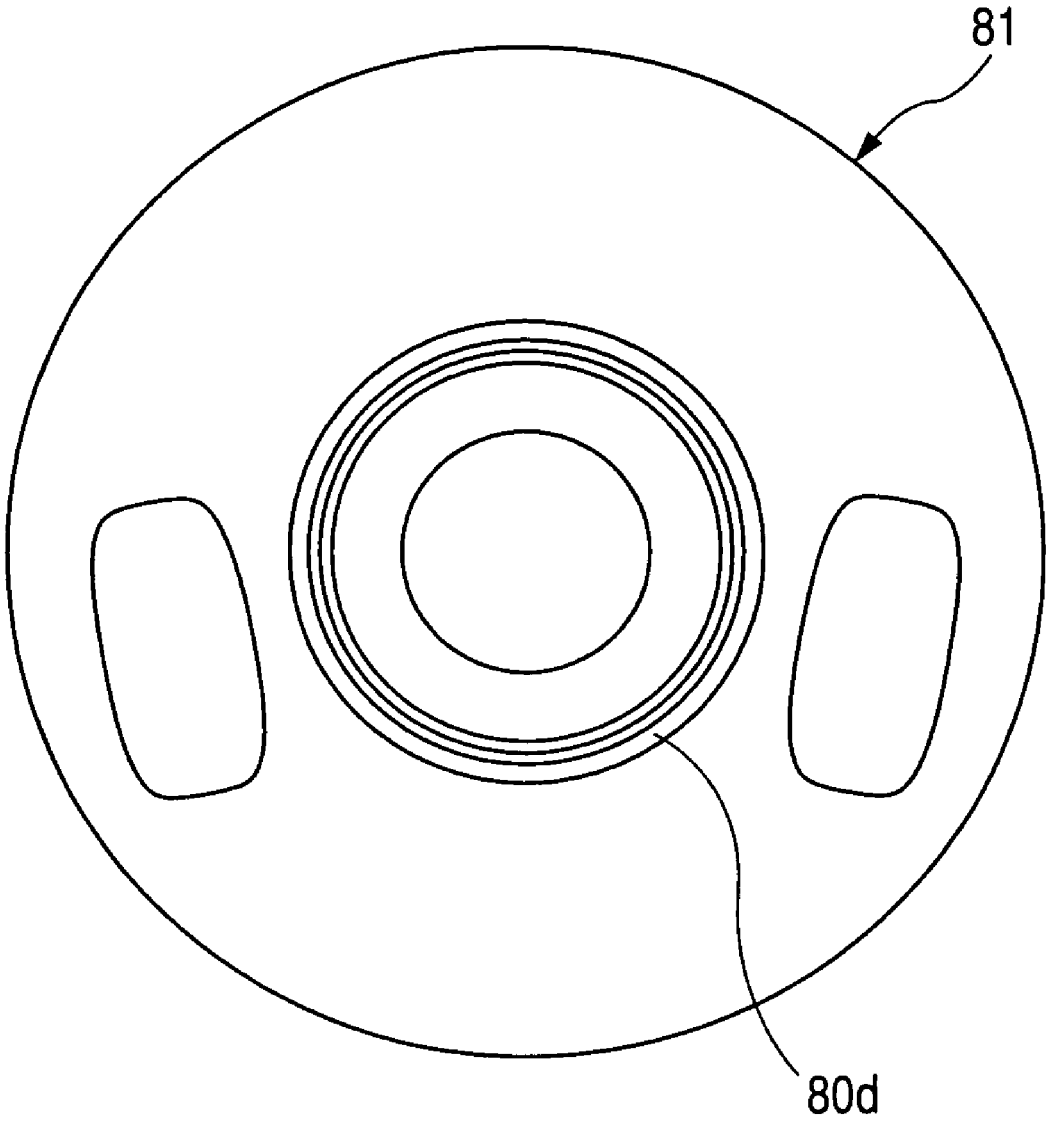
FIG. 15 is a front view which illustrates a modification of the magnetic core in FIGS. 12(*a*) and 12(*b*)

The core body 80 is made up of a base 80*a* and a boss 80*b*. The base 80*a* has an end facing the plunger 8 in an axial direction of the magnetic switch 1. The boss 80*b* protrudes from the other end of the base 80*a* away from the plunger 8. The boss 80*b* is press-fitted into the center hole 81*a* of the disc assembly 81. The outer edge of the boss 80*b* is then elastically bent outward to establish a tight joint of the core body 80 to the disc assembly 81. Specifically, the boss 80*b* has, as illustrated in FIGS. 12*a*, 12*b*, and 13, protrusions or tabs 80*c* formed on the outer corner thereof facing the inner periphery of the center hole 81*a* of the disc assembly 81. The firm joint between the disc assembly 81 and the core body 80 is achieved by staking or elastically bending the tabs 80*c* outwardly to establish a press fit of the boss 80*b* in the center hole 81*a* of the disc assembly 81. The tabs 80*c* are, as can be seen from FIG. 12(*a*), formed on the outer edge of the boss 80*b* and opposed diametrically to each other, but instead an elastically deformable annular protrusion or ridge 80*d* is, as shown in FIG. 15, formed on the corner of the boss 80*b*.

In operation of the magnetic switch 1, when the coil 5 is excited, it will cause the magnetic core 38 to be magnetized to create a magnetic attraction between the core body 80 of the magnetic core 38 and the plunger 8, thereby moving the plunger 8 to the core body 80 (i.e., the left, as viewed in FIG. 11) against the spring pressure of the return spring 11. The movement of the plunger 8 causes the plunger rod 9 to be pushed to bring the movable contact 17 into abutment with the fixed contacts 16. The plunger 8 is further moved against the pressure, as produced by a contact press spring 19, and abuts the end of the core body 80 (i.e., the base 80*a*), so that it stops. This causes the compressive pressure, as produced by the contact press spring 19, to be exerted on the movable contact 17 to secure the stability in abutment of the movable contact 17 with the fixed contacts 16, thereby starting the supply of electric power to the electric motor installed in the engine starter. After the start-up of the engine, the coil 5 is deenergized, so that the magnetic attraction disappears. The plunger 8 is then pushed backward by the spring pressure of the return spring 11, thereby moving the movable contact 17 away from the fixed contacts 16 to break the electric connection between the fixed contacts 17 to stop the supply of electric power to the motor of the engine starter.

The assembling of the magnetic core 8 is, as described above, achieved by press-fitting the boss 80*b* into the center hole 81*a* of the disc assembly 81 and then elastically expanding a portion(s) or the whole of the outer edge of the boss 80*b* outward to establish the tight joint of the core body 80 to the center hole 81*a* of the disc assembly 81. This ensures the stability of connection of the boss 80*b* to the center hole 81*a* regardless of a variation in shape of the sheets 82 of the disc assembly 81. Specifically, even when the center holes 82*a* of the sheets 82 vary in inner diameter, have distortions, or lack in sheared area thereof, a desired degree of press-fitting of the boss 80*b* in the center hole 81*a* of the disc assembly 81 is secured.

For example, even when the magnetic switch 1 is used in an automatic engine stop/restart system (usually called an idling stop/eco-run system) and turned on or off so many times, the strength of joint of the boss 80*b* to the disc assembly 81 which is great enough to withstand a return pressure, as exerted by a drive spring 29 illustrated in FIG. 11, on the plunger 8, when the plunger 8 is attracted to the core body 80 (i.e., the base 80*a*) of the magnetic core 38 is ensured, thus resulting in improved reliability in operation of the magnetic switch 1.

Figure 16:
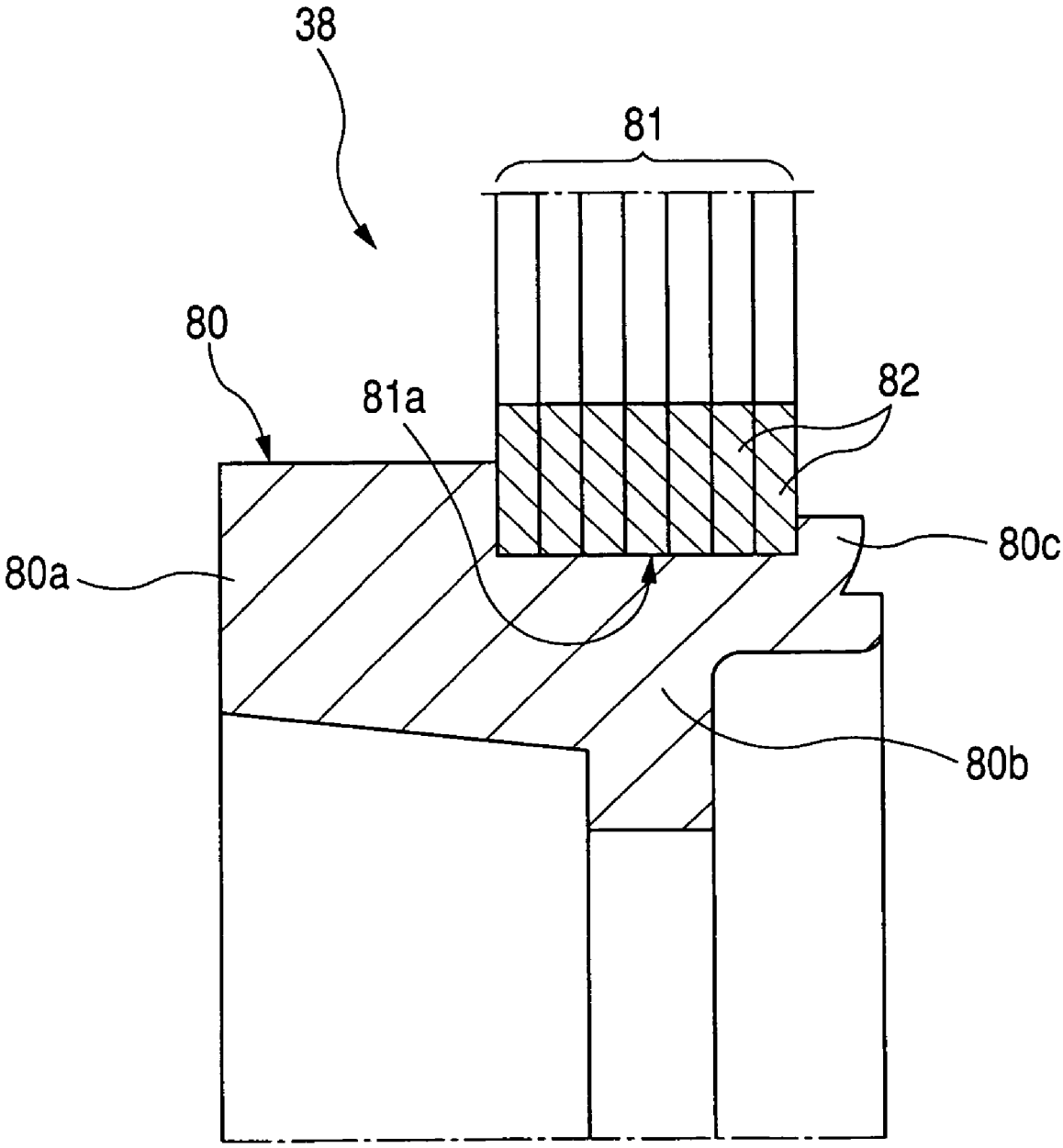
FIG. 16 is a partially enlarged sectional view which illustrates a magnetic core according to the fifth embodiment of the invention.

FIG. 16 illustrates the magnetic core 38 according to the fifth embodiment of the invention.

The magnetic core 38 has the boss 80*b* longer than that in the first and second embodiments in the axial direction thereof. Specifically, the length of the boss 80*b* in the axial direction of the core body 80 is, as can be seen in FIG. 16, is greater than a total thickness of the stack of sheets 82 of the disc assembly 81. The boss 80*b* is press-fit in the center hole 81*a* of the disc assembly 81 to have the top (i.e., the right end, as viewed in the drawing) extending outside the disc assembly 81 (i.e., the center hole 81*a*). The boss 80*b* has a tab(s) 80*c* which is elastically bent outward in the radius direction thereof to create a firm nip which holes the sheets 82 of the disc assembly 81 tightly to ensure the joint between the core body 80 and the disc assembly 81. In stead of the tab(s) 80*c*, an annular ridge may alternatively be formed on the corner of the boss 80*b*.

Figure 17:
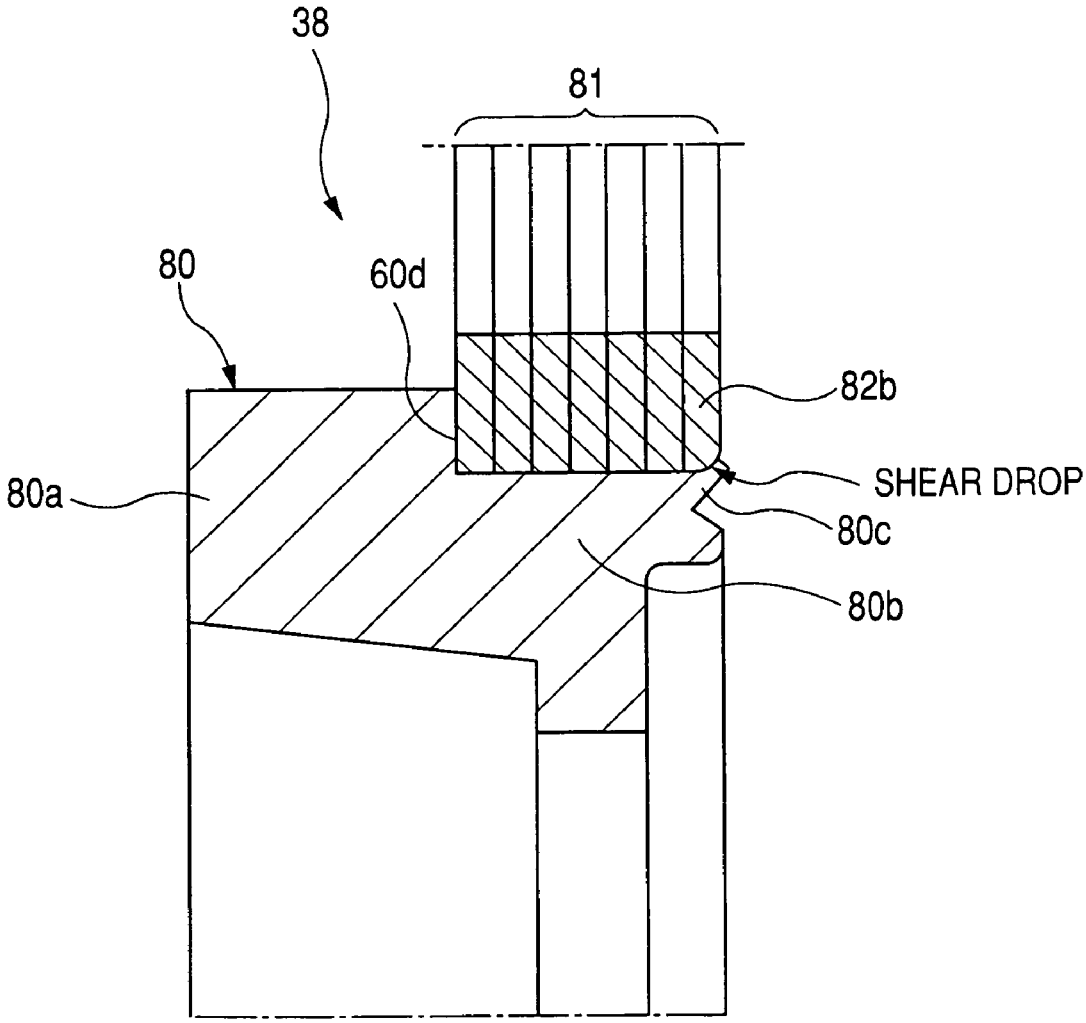
FIG. 17 is a partially enlarged sectional view which illustrates a magnetic core according to the sixth embodiment of the invention.

FIG. 17 illustrates the magnetic core 38 according to the sixth embodiment of the invention.

Figure 18A:
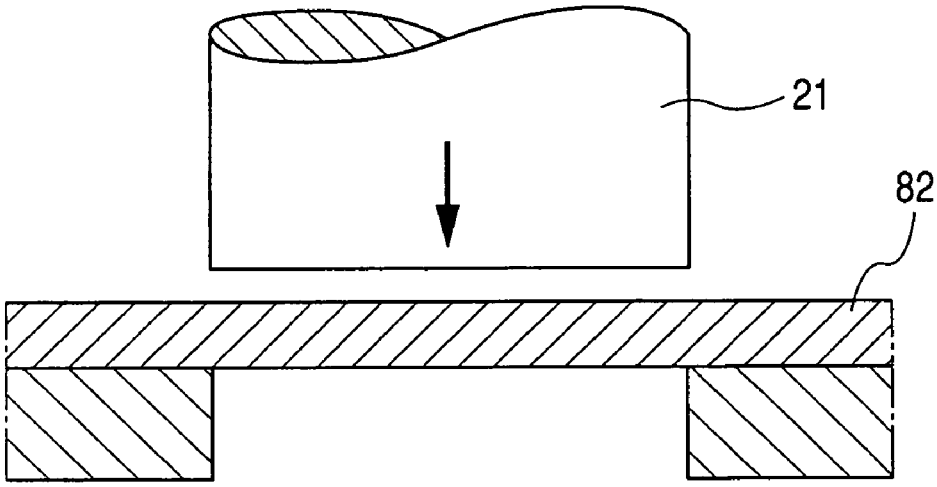
FIGS. 18(*a*) and 18(*b*) are side views which illustrate a sequence of process of punching a center hole of each of sheets of the disc assembly of FIG. 17.
Figure 18B:
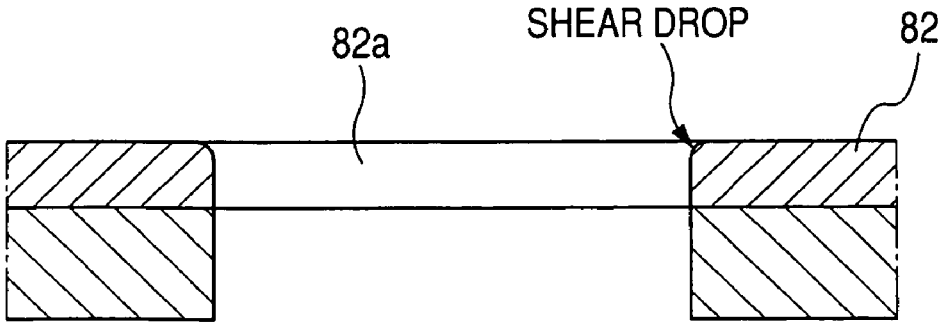

Each of the sheets 82 has, like the second embodiment, the center hole 82*a*, as illustrated in FIG. 18(*b*). The center hole 82*a* is, as illustrated in FIG. 18(*a*), formed by pressing the center of the sheet 82 placed on a die using a punch 21. Usually, when the center hole 82*a* is punched out, it results in formation of a shear drop on the inner peripheral corner (i.e., an upper corner, as viewed in FIG. 18(*b*)) of the center hole 82*a*, so that the inner peripheral corner is curved or rounded.

The disc assembly 81 of this embodiment is so designed as to orient the outermost one of the sheets 82 of the disc assembly 81, that is, the rightmost one, as denoted by a reference number 82*b* in FIG. 17, farthest away from the base 80*a* of the core body 80 to have the rounded inner peripheral corner of the center hole 82*a* facing outward (i.e., the right, as viewed in FIG. 17).

The installation of the disc assembly 81 on the magnetic core 38 is achieved by press-fitting the stack of the sheets 82 on the boss 80*b* of the core body 80 and elastically bending a tab(s) 80*c* formed on the outer peripheral edge or corner of the boss 80*b* outward in the radius direction of the boss 80*b* into abutment with the rounded inner peripheral corner of the center hole 82*a* of the sheet 82*b* of the disc assembly 81, thereby exerting elastic pressure on the stack of the sheets 82 in an obliquely upward left direction, as viewed in FIG. 17. Specifically, the elastic pressure acts on the stack of the sheets 82 both in the radially outward direction of the disc assembly 81 and in a direction in which the stack of the sheets 82 is pressed against the shoulder 60*d* of the base 80*a*, that is, compressed in the axial direction of the disc assembly 81. This ensures the firm joint between the core body 80 and the disc assembly 81. In stead of the tab(s) 80*c*, an annular ridge may alternatively be formed on the corner of the boss 80*b*.

Figure 19:
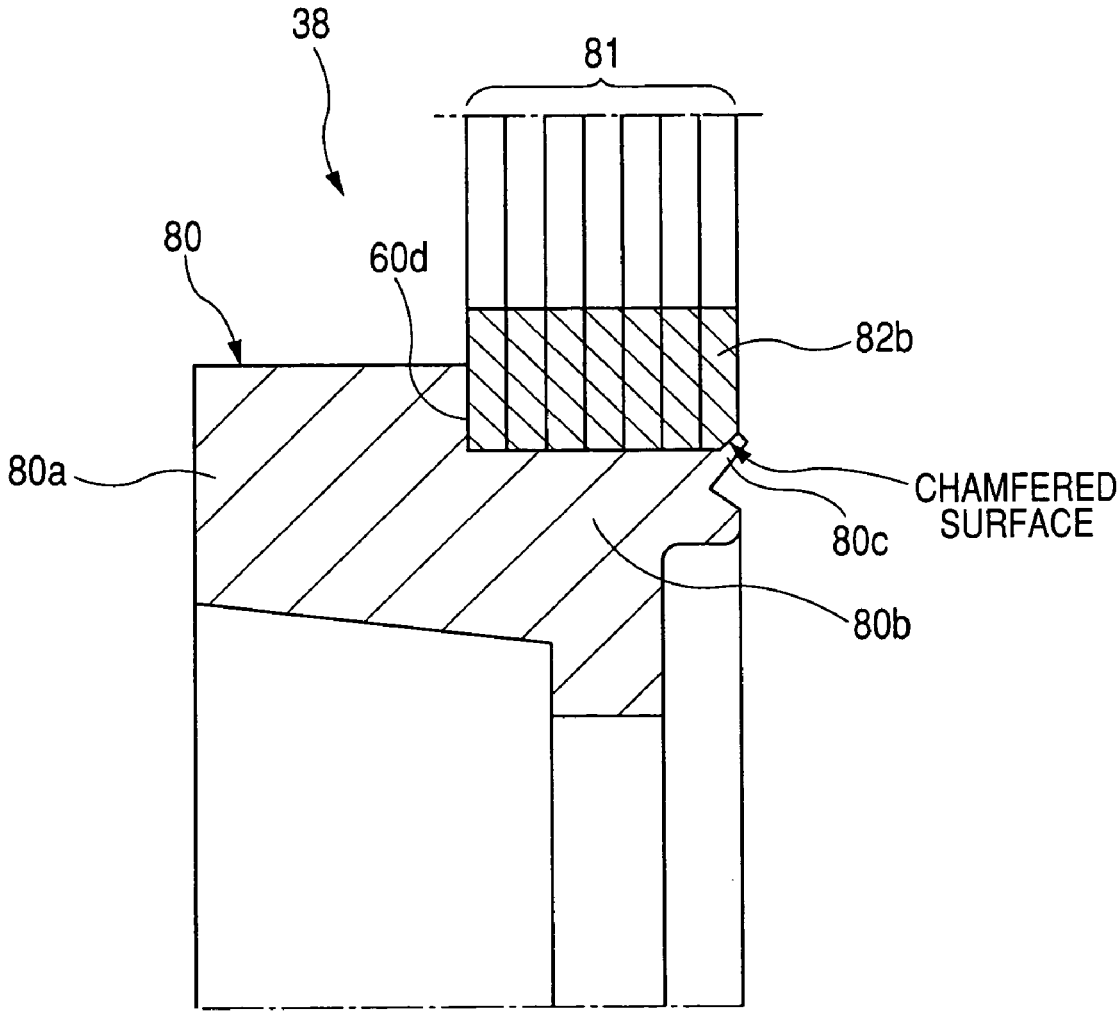
FIG. 19 is a partially enlarged sectional view which illustrates a magnetic core according to the seventh embodiment of the invention.
Figure 20:
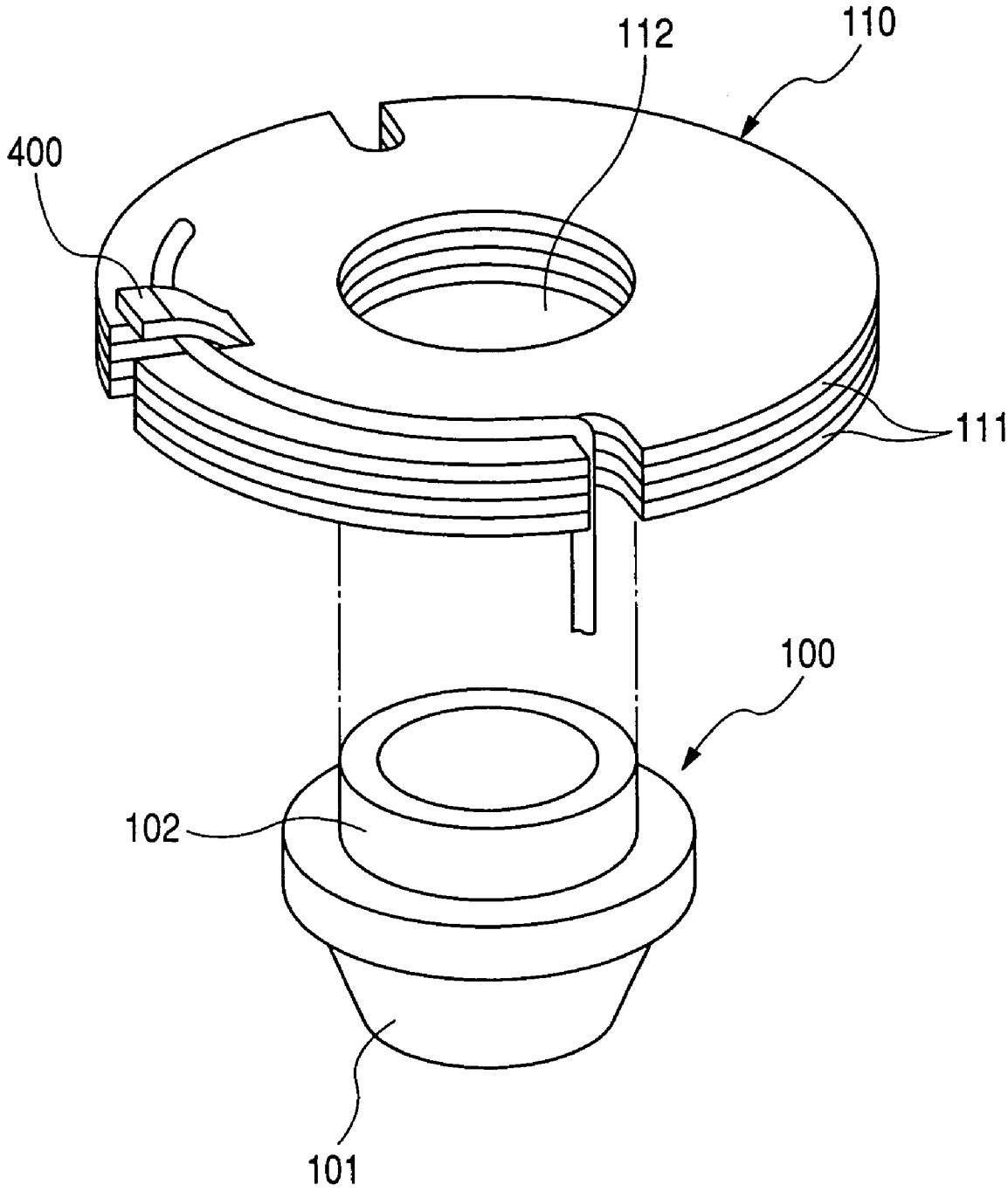
FIG. 20 (PRIOR ART)
FIG. 20 is a perspective view which shows a magnetic core of a conventional magnetic switch.

FIG. 19 illustrates the magnetic core 38 according to the seventh embodiment of the invention which is a modification of the one in the sixth embodiment.

Specifically, the inner peripheral corner of the center hole 82*a* of the sheet 82*b* is chamfered. The disc assembly 81 is so designed as to orient the sheet 82*b* to have the chamfered inner peripheral edge or corner facing outward (i.e., the right as viewed in the drawing).

The installation of the disc assembly 81 on the magnetic core 38 is achieved by press-fitting the stack of the sheets 82 on the boss 80*b* of the core body 80 and elastically bending a tab(s) 80*c* formed on the outer peripheral edge or corner of the boss 80*b* outward in the radius direction of the boss 80*b* into abutment with the chamfered inner corner of the center hole 82*a* of the sheet 82*b* of the disc assembly 81, thereby exerting elastic pressure on the stack of the sheets 82 in an obliquely upward left direction, as viewed in FIG. 19. Specifically, the elastic pressure acts on the stack of the sheets 82 both in the radially outward direction of the disc assembly 81 and in a direction in which the stack of the sheets 82 is pressed against the shoulder 60*d* of the base 80*a*, that is, compressed in the axial direction of the disc assembly 81. This ensures the firm joint between the core body 80 and the disc assembly 81. In stead of the tab(s) 80*c*, an annular ridge may alternatively be formed on the corner of the boss 80*b*.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

For example, the magnetic switch 1 is of a normally open type, but may alternatively be designed as a normally closed type to move the movable contact 17 away from the fixed contacts 16 when the coil 5 is excited.

What is claimed is:

1. A magnet switch comprising:

a stationary core;

a movable core; and a magnetic coil that, when excited, produces magnetic attraction through said stationary core to attract said movable core along a given travel path to one of open and close electric contacts, wherein said stationary core includes a disc assembly and a core body, the core body having opposed ends, a base, a boss, and an outer shoulder formed between the base and the boss, the base having an end that is one of the opposed ends which faces said movable core, the boss having an end that is the other of the opposed ends which is away from said movable core across the base, and wherein the disc assembly is made of a stack of annular plate members superposed on each other in a thickness-wise direction thereof and has a fitting hole extending through a thickness of the stack, each of the annular plate members having a circular center hole which defines the fitting hole of the disc assembly, the disc assembly being fit at the fitting hole on the boss, and wherein at least a portion of an edge of the end of the boss is plastically deformed outward in a radius direction of the boss to create an elastic nip which retains the stack of the annular plate members of the disc assembly between the edge and the outer shoulder of the core body, and an outermost one of the annular plate members of the disc assembly which is located far away from the base has a shear drop on an inner circumferential edge of the center hole thereof which has arisen from punching out the circular center holes in the stack of the annular plate members in the thickness-wise direction thereof, and wherein the plastically deformed edge of the end of the boss is in abutment with the shear drop of the outermost one of the annular plate members.

2. The magnet switch as set forth in claim 1, wherein the plastically deformed edge of the end of the boss is placed on the entire shear drop of the outermost one of the annular plate members.

3. A magnet switch comprising:

a stationary core;

a movable core; and a magnetic coil that, when excited, produces magnetic attraction through said stationary core to attract said movable core along a given travel path to one of open and close electric contacts, wherein said stationary core includes a disc assembly and a core body, the core body having opposed ends, a base, a boss, and an outer shoulder formed between the base and the boss, the base having an end that is one of the opposed ends which faces said movable core, the boss having an end that is the other of the opposed ends which is away from said movable core across the base, and wherein the disc assembly is made of a stack of annular plate members superposed on each other in a thickness-wise direction thereof and has a fitting hole extending through a thickness of the stack, each of the annular plate members having a circular center hole which defines the fitting hole of the disc assembly, the disc assembly being fit at the fitting hole on the boss, and wherein at least a portion of an edge of the end of the boss is plastically deformed outward in a radius direction of the boss to create an elastic nip which retains the stack of the annular plate members of the disc assembly between the edge and the outer shoulder of the core body, and an outermost one of the annular plate members of the disc assembly which is located far away from the base has a chamfered surface formed on an inner circumferential edge of the center hole thereof, and wherein the plastically deformed edge of the end of the boss is in abutment with the chamfered surface of the outermost one of the annular plate members.

* * * * *